US011264727B2

(12) United States Patent
Zimmerman et al.

(10) Patent No.: US 11,264,727 B2
(45) Date of Patent: Mar. 1, 2022

(54) LENSED BASE STATION ANTENNAS HAVING STAGGERED VERTICAL ARRAYS FOR AZIMUTH BEAM WIDTH STABILIZATION

(71) Applicant: CommScope Technologies LLC, Hickory, NC (US)

(72) Inventors: Martin L. Zimmerman, Chicago, IL (US); Michel Dembinski, Dallas, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/266,860

(22) PCT Filed: Aug. 21, 2019

(86) PCT No.: PCT/US2019/047501

§ 371 (c)(1),
(2) Date: Feb. 8, 2021

(87) PCT Pub. No.: WO2020/041467

PCT Pub. Date: Feb. 27, 2020

(65) Prior Publication Data

US 2021/0296785 A1 Sep. 23, 2021

Related U.S. Application Data

(60) Provisional application No. 62/799,350, filed on Jan. 31, 2019, provisional application No. 62/722,238, filed on Aug. 24, 2018.

(51) Int. Cl.
*H01Q 15/08* (2006.01)
*H01Q 1/24* (2006.01)
(Continued)

(52) U.S. Cl.
CPC ..... *H01Q 15/08* (2013.01); *H01Q 1/246* (2013.01); *H01Q 19/06* (2013.01); *H01Q 21/062* (2013.01); *H01Q 21/20* (2013.01)

(58) Field of Classification Search
CPC ..... H01Q 1/246; H01Q 15/08; H01Q 19/06; H01Q 21/062; H01Q 21/20
See application file for complete search history.

(56) References Cited

U.S. PATENT DOCUMENTS

2008/0117114 A1 5/2008 Haziza
2008/0246681 A1 10/2008 Deng et al.
(Continued)

FOREIGN PATENT DOCUMENTS

CN 201490345 U 5/2010
CN 105874646 A 8/2016
(Continued)

OTHER PUBLICATIONS

"International Search Report and Written Opinion of the International Searching Authority", International Application Mo. PCT/US2019/047501, dated Dec. 23, 2019, 12 pp.
(Continued)

*Primary Examiner* — Robert Karacsony
(74) *Attorney, Agent, or Firm* — Myers Bigel, P.A.

(57) ABSTRACT

A lensed base station antenna includes a first array that includes a plurality of first radiating elements that are configured to transmit respective sub-components of a first RF signal, a second array that includes a plurality of second radiating elements that are configured to transmit respective sub-components of a second RF signal and an RF lens structure positioned to receive electromagnetic radiation from a first of the first radiating elements and from a first of the second radiating elements. A first subset of the first radiating elements are aligned along a first vertical axis and
(Continued)

a second subset of the first radiating elements are aligned along a second vertical axis that is spaced apart from the first vertical axis. The first and second arrays each include a single radiating element per horizontal row.

20 Claims, 16 Drawing Sheets

(51) Int. Cl.

| | |
|---|---|
| ***H01Q 19/06*** | (2006.01) |
| ***H01Q 21/06*** | (2006.01) |
| ***H01Q 21/20*** | (2006.01) |

(56) References Cited

U.S. PATENT DOCUMENTS

| | | | |
|---|---|---|---|
| 2008/0309568 | A1 | 12/2008 | Deng et al. |
| 2011/0205119 | A1 | 8/2011 | Timofeev et al. |
| 2015/0091767 | A1 | 4/2015 | Matitsine et al. |
| 2018/0062258 | A1 | 3/2018 | Timofeev et al. |
| 2018/0131078 | A1 | 5/2018 | Shooshtari et al. |

FOREIGN PATENT DOCUMENTS

| | | | |
|---|---|---|---|
| EP | 3255730 | A1 | 12/2017 |
| WO | 2015139294 | A1 | 9/2015 |
| WO | 2018089340 | A1 | 5/2018 |

OTHER PUBLICATIONS

"Invitation to Pay Additional Fees and, Where Applicable, Protest Fee", International Application No. PCT/US2019/047501, dated Oct. 24, 2019, 2 pp.

"First Office Action for Chinese Application No. 201980055834.3, dated Nov. 11, 2021".

| NAME | | MIN | MAX | MEAN | STDV | TOL |
|---|---|---|---|---|---|---|
| OVERALL | | 26.91 | 40.34 | 22.32 | 4.37 | 3.62 |

| NAME | | MIN | MAX | MEAN | STDV | TOL |
|---|---|---|---|---|---|---|
| OVERALL | | 29.47 | 36.31 | 32.00 | 3.40 | 4.08 |

| NAME | | MIN | MAX | MEAN | STDV | TOL |
|---|---|---|---|---|---|---|
| OVERALL | | 44.16 | 72.90 | 56.93 | 8.01 | 17.08 |

| NAME | | MIN | MAX | MEAN | STDV | TOL |
|---|---|---|---|---|---|---|
| OVERALL | | 41.10 | 96.50 | 57.94 | 5.51 | 10.94 |

| NAME | | MIN | MAX | MEAN | STDV | TOL |
|---|---|---|---|---|---|---|
| OVERALL | | 47.38 | 83.04 | 30.57 | 8.64 | 22.87 |

| NAME | | MIN | MAX | MEAN | STDV | TOL |
|---|---|---|---|---|---|---|
| OVERALL | | 62.62 | 74.74 | 82.90 | 5.74 | 11.79 |

LENSED BASE STATION ANTENNAS HAVING STAGGERED VERTICAL ARRAYS FOR AZIMUTH BEAM WIDTH STABILIZATION

CROSS-REFERENCE TO RELATED APPLICATIONS

The present application is a 35 U.S.C. § 371 national stage application of PCT Application No. PCT/US2019/047501, filed Aug. 21, 2019, which itself claims priority to U.S. Provisional Patent Application Ser. No. 62/799,350, filed Jan. 31, 2019 and to U.S. Provisional Patent Application Ser. No. 62/722,238, filed Aug. 24, 2018, the entire content of each of which is incorporated herein by reference. The above-referenced PCT Application was published in the English language as International Publication No. WO 2020/041467 A1 on Feb. 27, 2020.

FIELD OF THE INVENTION

The present invention generally relates to radio communications and, more particularly, to lensed antennas utilized in cellular and other communications systems.

BACKGROUND

Cellular communications systems are well known in the art. In a typical cellular communications system, a geographic area is divided into a series of regions that are referred to as "cells," and each cell is served by a base station. The base station may include baseband equipment, radios and base station antennas that are configured to provide two-way radio frequency ("RF") communications with subscribers that are positioned throughout the cell. In many cases, the cell may be divided into a plurality of "sectors," and separate base station antennas provide coverage to each of the sectors. The antennas are often mounted on a tower or other raised structure, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular relative to the plane defined by the horizon.

A very common base station configuration is a so-called "three sector" configuration in which the cell is divided into three 120° sectors in the azimuth plane, and the base station includes three base station antennas that provide coverage to the three respective sectors. The azimuth plane refers to a horizontal plane that bisects the base station antenna that is parallel to the plane defined by the horizon. In a three sector configuration, the antenna beams generated by each base station antenna typically have a Half Power Beam Width ("HPBW") in the azimuth plane of about 65° so that the antenna beams provide good coverage throughout a 120° sector. Typically, each base station antenna will include a vertically-extending column of radiating elements that is typically referred to as a "linear array." Each radiating element in the linear array may have a HPBW of approximately 65° so that the antenna beam generated by the linear array will provide coverage to a 120° sector in the azimuth plane.

Sector-splitting refers to a technique where the coverage area for a base station is divided into more than three sectors, such as six, nine or even twelve sectors. A six-sector base station will have six 60° sectors in the azimuth plane. Splitting each 120° sector into multiple smaller sub-sectors increases system capacity because each antenna beam provides coverage to a smaller area, and therefore can provide higher antenna gain and/or allow for frequency reuse within a 120° sector. In sector-splitting applications, a single multi-beam antenna is typically used for each 120° sector. The multi-beam antenna generates two or more antenna beams within the same frequency band, thereby splitting the sector into two or more smaller sectors. Sector-splitting typically requires a multi-column array of radiating elements. The two common approaches for sector-splitting are sector-splitting using beam-forming networks such as a Butler matrix and sector-splitting using lensed antennas.

In the first sector-splitting approach, a multi-column array of radiating elements is driven by a feed network that includes a Butler matrix or other beam-forming network to produce two or more antenna beams from the multi-column array. For example, if the multi-column array is used to generate two side-by-side antenna beams that each have an azimuth HPBW of about 33°, then three base station antennas may be used to implement a six-sector configuration. Antennas having multi-column arrays that generate multiple beams are disclosed, for example, in U.S. Patent Publication No. 2011/0205119.

In the second sector-splitting approach, an RF lens is included in the base station antenna and multiple linear arrays are configured to transmit and receive signals in different directions through the RF lens. The RF lens may be used to narrow the azimuth beam width of the antenna beams generated by the linear arrays to beam widths that are suitable for providing service to a sub-sector. Thus, for example, for a six-sector base station served by three base station antennas, the RF lens would be designed to narrow the azimuth HPBW of each antenna beam to about 33°.

Applications for multi-beam antennas may require a minimum pattern cross-over to cover a sector while lowering interference. The "cross-over" performance of an antenna beam generated by a multi-beam antenna refers to the reduction from the peak gain level (in the azimuth plane) at the point where the antenna beam and an adjacent antenna beam have the same gain. For example, a multi-beam antenna will have a 10 dB cross-over if the azimuth patterns for two adjacent antenna beams cross each other at a level that is 10 dB down from the peak gain of the azimuth pattern. However, each of the above-described approaches for sector-splitting may not provide acceptable cross-over performance, particularly if the antenna includes broadband arrays that operate over a large frequency band.

SUMMARY

Pursuant to embodiments of the present invention, lensed base station antennas are provided that include a first array has includes a plurality of first radiating elements that are configured to transmit respective sub-components of a first RF signal, a second array that includes a plurality of second radiating elements that are configured to transmit respective sub-components of a second RF signal and an RF lens structure that is positioned to receive electromagnetic radiation from a first of the first radiating elements and from a first of the second radiating elements. A first subset of the first radiating elements are aligned along a first vertical axis and a second subset of the first radiating elements are aligned along a second vertical axis that is spaced apart from the first vertical axis. The first array includes a single radiating element per horizontal row in the first array, and the second array includes a single radiating element per horizontal row in the second array.

In some embodiments, a first subset of the second radiating elements are aligned along a third vertical axis and a second subset of the second radiating elements are aligned along a fourth vertical axis that is spaced apart from the third vertical axis.

In some embodiments, the first radiating elements are mounted to extend forwardly from a first section of a reflector and the second radiating elements are mounted to extend forwardly from a second section of the reflector, and a front surface of a first plane defined by the first section of the reflector and a front surface of a second plane defined by the second section of the reflector intersect at an oblique angle. In some embodiments, the oblique angle may be between 100° and 140°.

In some embodiments, the lensed base station antenna may further include a plurality of first feed boards. Each first feed board has two or more of the first radiating elements mounted thereon, wherein a first subset of the first feed boards are aligned along the first vertical axis and a second subset of the first feed boards are aligned along the second vertical axis.

In some embodiments, a horizontal distance between the first vertical axis and the second vertical axis is between 0.1 and 0.5 wavelengths of a center frequency of an operating frequency band of the first radiating elements.

In some embodiments, a boresight pointing direction for the first of the first radiating elements does not intersect a longitudinal axis that extends through a center of the RF lens structure.

In some embodiments, the RF lens structure comprises a cylindrical RF lens structure having a vertically-extending longitudinal axis.

In some embodiments, an operating frequency band for the first radiating elements is within the 1.7-2.7 GHz frequency band and a horizontal distance between the first vertical axis and the second vertical axis is between 20-75 mm.

In some embodiments, half of the first radiating elements are aligned along the first vertical axis and the other half of the first radiating elements are aligned along the second vertical axis.

In some embodiments, a third subset of the first radiating elements are aligned along a third vertical axis that is between the first vertical axis and the second vertical axis.

In some embodiments, the lensed base station antenna may further include a third array that includes a plurality of third radiating elements that are configured to transmit respective sub-components of a third RF signal. In these embodiments a first subset of the third radiating elements may be aligned along a fifth vertical axis and a second subset of the third radiating elements may be aligned along a sixth vertical axis that is spaced apart from the fifth vertical axis, and the RF lens structure may be positioned to receive electromagnetic radiation from a first of the third radiating elements.

In some embodiments, the RF lens structure may comprise a plurality of ellipsoidal RF lenses that extend along a vertical axis.

In some embodiments, the first array may be configured to cover a first sub-sector of a 120° sector and the second array may be configured to cover a second different sub-sector of the 120° sector.

In some embodiments, a minimum vertical spacing between two vertically-adjacent radiating elements that are aligned along the first vertical axis may be greater than a minimum vertical spacing between a radiating element that is aligned along the first vertical axis and a vertically-adjacent radiating element that is aligned along the second vertical axis.

Pursuant to further embodiments of the present invention, lensed base station antennas are provided that include a first RF port, a first array that includes a plurality of radiating elements that are connected via a feed network to the first RF port, wherein a first vertical axis that passes through a center of a first of the radiating elements in the first array is spaced apart from a second vertical axis that passes through a center of a second of the radiating elements in the first array, a second RF port, and a second array that includes a plurality of radiating elements that are connected via a feed network to the second RF port, wherein a third vertical axis that passes through a center of a first of the radiating elements in the second array is spaced apart from a fourth vertical axis that passes through a center of a second of the radiating elements in the second array. These antenna further include an RF lens structure that is positioned to receive electromagnetic radiation from at least one of the radiating elements in the first array and from at least one of the radiating elements in the second array.

In some embodiments, the radiating elements of the first array may be arranged in at least two columns and a plurality of rows, and at least some of the rows of radiating elements in the first array may include a single radiating element, and the radiating elements of the second array may likewise be arranged in at least two columns and a plurality of rows, and at least some of the rows of radiating elements in the second array may include a single radiating element.

In some embodiments, all of the rows of radiating elements in the first array include a single radiating element, and all of the rows of radiating elements in the second array include a single radiating element.

In some embodiments, the lensed base station antenna may further include a plurality of first feed boards, each first feed board having two or more of the radiating elements in the first array mounted thereon. In these embodiments, a first subset of the first feed boards may be aligned along the first vertical axis and a second subset of the first feed boards may be aligned along the second vertical axis.

In some embodiments, a horizontal distance between the first vertical axis and the second vertical axis may be between 0.1 and 0.5 wavelengths of a center frequency of an operating frequency band of the radiating elements in the first array.

In some embodiments, the first array may be configured to cover a first sub-sector of a 120° sector and the second array may be configured to cover a second different sub-sector of the 120° sector, and a peak amplitude of an antenna beam generated by the first array is at an azimuth angle that is offset from an azimuth angle that is at a center of the first sub-sector.

In some embodiments, half of the radiating elements in the first array may be aligned along the first vertical axis and the other half of the radiating elements in the first array may be aligned along the second vertical axis.

In some embodiments, a subset of the radiating elements in the first array may be aligned along a third vertical axis that is between the first vertical axis and the second vertical axis.

In some embodiments, at least some of the radiating elements in the first array are mounted to extend forwardly from a first section of a reflector and at least some of the radiating elements in the second array are mounted to extend forwardly from a second section of the reflector, and a front surface of a first plane defined by the first section of the reflector and a front surface of a second plane defined by the second section of the reflector intersect at an oblique angle that is between 100° and 140°.

In some embodiments, a vertical spacing between two vertically-adjacent radiating elements that are aligned along the first vertical axis may be greater than a vertical spacing between a radiating element that is aligned along the first vertical axis and a vertically-adjacent radiating element that is aligned along the second vertical axis.

Pursuant to still further embodiments of the present invention, lensed base station antennas are provided that are configured to transmit signals in both a low frequency band and a high frequency band. These antennas include a first RF port, a first array that includes a plurality of radiating elements that are connected via a feed network to the first RF port, each radiating element in the first array vertically spaced apart from all other radiating elements in the first array, and an RF lens structure positioned to receive electromagnetic radiation from at least one of the radiating elements in the first array. At least some of the radiating elements in the first array are staggered in a horizontal direction from others of the radiating elements in the first array and positioned at a distance from the RF lens structure so that a first antenna beam generated by the first array in response to an RF signal in the high frequency band is narrower in an azimuth plane than a second antenna beam generated by the first array in response to an RF signal in the low frequency band.

In some embodiments, the lensed base station antenna further includes a second array that includes a plurality of radiating elements that are connected via a second feed network to a second RF port, each radiating element in the second array vertically spaced apart from all other radiating elements in the second array. In such embodiments, the RF lens structure is further positioned to receive electromagnetic radiation from at least one of the radiating elements in the second array, and wherein at least some of the radiating elements in the second array are staggered in a horizontal direction from others of the radiating elements in the second array.

In some embodiments, the radiating elements in the first array may be mounted to extend forwardly from a first section of a reflector and the radiating elements in the second array may be mounted to extend forwardly from a second section of the reflector, and wherein a front surface of a first plane defined by the first section of the reflector and a front surface of a second plane defined by the second section of the reflector intersect at an oblique angle that is between 100° and 140°.

In some embodiments, the lensed base station antenna further includes a plurality of first feed boards, each first feed board having two or more of the radiating elements in the first array mounted thereon, where a first subset of the first feed boards are aligned along a first vertical axis and a second subset of the first feed boards are aligned along a second vertical axis.

In some embodiments, a horizontal distance between the first vertical axis and the second vertical axis may be between 0.1 and 0.5 wavelengths of a center frequency of an operating frequency band of the radiating elements in the first array.

In some embodiments, half of the radiating elements in the first array may be aligned along the first vertical axis and the other half of the radiating elements in the first array may be aligned along the second vertical axis.

In some embodiments, the first array may be configured to cover a first sub-sector of a 120° sector and the second array may be configured to cover a second different sub-sector of the 120° sector. In such embodiments, a peak amplitude of an antenna beam generated by the first array may be at an azimuth angle that is offset from an azimuth angle that is at a center of the first sub-sector.

In some embodiments, a vertical spacing between two vertically-adjacent radiating elements that are aligned along a first vertical axis may be greater than a vertical spacing between a radiating element that is aligned along the first vertical axis and a vertically-adjacent radiating element that is aligned along a second vertical axis.

Pursuant to additional embodiments of the present invention, lensed base station antennas are provided that include a frame that includes a reflector, at least one array of radiating elements mounted to extend forwardly from the reflector, and an RF lens mounted forwardly of the at least one array of radiating elements, the RF lens including a lens casing having a body and a first lens end cap mounted on a first end of the body, and one or more RF focusing materials within the lens casing. The first lens end cap includes a first flange that is configured to mount the RF lens to the frame.

In some embodiments, the body comprises fiberglass.

In some embodiments, the first end cap further includes a second flange, and the first and second flanges are attached to the frame.

In some embodiments, the lens casing further includes a second end cap that is attached to a second end of the body that is opposite the first end, and the second lens end cap includes third and fourth flanges that are configured to mount the second end of the RF lens to the frame.

In some embodiments, the first end cap is attached to the reflector.

In some embodiments, the first flange includes at least one mounting point.

In some embodiments, the first lens end cap includes a plurality of ribs.

DETAILED DESCRIPTION

Figure 1A:
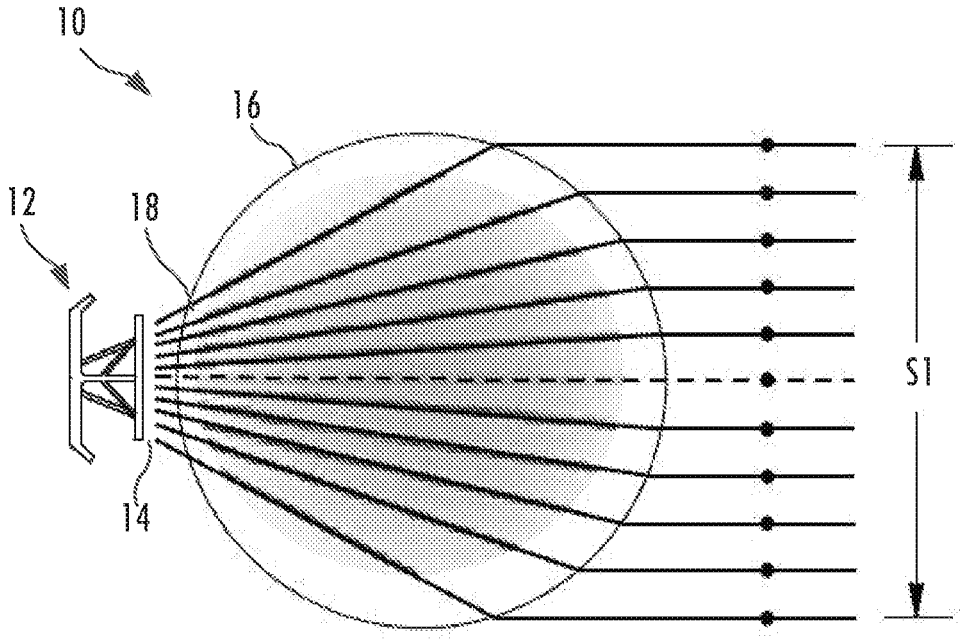
FIGS. 1A and 1B are schematic top views of a lensed base station antenna that illustrate how variation of the azimuth beam width of a linear array as a function of frequency may be used to provide azimuth beam width stability.

While RF lenses provide a convenient mechanism for implementing sector-splitting, various difficulties may arise when trying to use lensed multi-beam antennas in practice. One such difficulty is achieving acceptable cross-over performance, particularly for base station antennas that operate in the 1.7-2.7 GHz frequency band (or other broad frequency bands). Generally speaking, the azimuth beamwidth of an antenna beam generated by a radiating element will decrease as the frequency of the RF signal that generates the antenna beam increases. However, in order to provide azimuth beam width stability, most radiating elements are designed to counter this effect so that the antenna beams generated by the radiating element will have a relatively constant beam width in the azimuth plane across the operating frequency for the radiating element. Designing the radiating elements so that they generate antenna beams that have relatively stable azimuth beam widths across the operating frequency band helps ensure that acceptable cross-over performance will be achieved for RF signals at all frequencies within the operating frequency band.

The amount that an RF lens focuses RF energy is a function of the frequency of the RF signal, with increased focusing of the RF energy (and hence narrowing of the azimuth beam width) occurring with increased frequency. As such, an RF lens will tend to focus RF energy in the upper portion of an operating frequency band more than RF energy in a lower portion of the operating frequency band, making it difficult to achieve acceptable cross-over performance over the entire operating frequency band if the radiating elements are designed to generate antenna beams that have a relatively constant azimuth beam width across the operating frequency band. It may be particularly difficult to achieve acceptable cross-over performance across the entire operating frequency band in cases where the operating frequency band is large, such as the 1.7-2.7 GHz frequency band.

U.S. Patent Publication No. 2015/0091767 ("the '767 publication") suggests using a box dipole radiating element as a technique for stabilizing the azimuth beam width as a function of frequency for lensed multi-beam antennas. U.S. Patent Publication No. 2018/0131078 ("the '078 publication") describes a variety of additional techniques for stabilizing the azimuth beam width as a function of frequency for lensed multi-beam antennas, including (1) the use of side-by-side radiating elements (i.e., paired radiating elements in the horizontal direction), (2) the use of alternating single radiating elements with side-by-side radiating elements, (3) the use of H-V dipole structures, and (4) the use of box radiating elements with two or more parasitic structures. However, each of these techniques has various potential disadvantages in some applications. For example, the use of side-by-side radiating elements and/or the use of alternating single radiating elements with side-by-side radiating elements may result in excessive coupling between the side-by-side radiating elements due to the small distance therebetween. This coupling can distort the resulting antenna beam. Likewise, the use of H-V dipole structures requires the provision of a 180° hybrid coupler for each radiating element to convert to +/−45° polarization. Box radiating elements may be more expensive to manufacture than other commonly-used radiating elements and/or may not provide sufficient azimuth beam width stabilization when the operating frequency band is large, such as in the case of the 1.7-2.7 GHz frequency band.

Pursuant to embodiments of the present invention, lensed base station antennas are provided that may exhibit good azimuth beam width stability, even over large operating frequency bands such as the 1.7-2.7 GHz band. These base station antennas include "staggered" vertical arrays of radiating elements. Herein, a staggered vertical array refers to an array of radiating elements in which the radiating elements are spaced apart from one another in the vertical direction with at least some of the radiating elements staggered in the horizontal direction with respect to other of the radiating elements by a relatively small distance. Thus, a staggered vertical array generally extends vertically, but the radiating elements are aligned along two or more vertical axes instead of all being aligned along the same vertical axis, as is the case in a conventional vertically-oriented linear array of radiating elements. Each staggered vertical array may only have one radiating element per row, and hence may avoid the excessive coupling problems that may result when two radiating elements are provided per row as disclosed in the '078 publication. Moreover, the staggering of the radiating elements in the horizontal direction may configure the array to have an azimuth beam width versus frequency relationship that is generally opposite the azimuth beam width versus frequency relationship of the RF lens structure so that the lensed antenna will have good azimuth beam width stability as a function of frequency.

In some embodiments, the lensed base station antennas may comprise sector-splitting antennas that include two, three or even more staggered vertical arrays of radiating elements. In such embodiments, the antenna may include a first array of first radiating elements that are configured to transmit respective sub-components of a first radio frequency ("RF") signal, a second array of second radiating elements that are configured to transmit respective sub-components of a second RF signal, and an RF lens structure that is positioned to receive electromagnetic radiation from a first of the first radiating elements and from a first of the second radiating elements. A first subset of the first radiating elements are aligned along a first vertical axis and a second subset of the first radiating elements are aligned along a second vertical axis that is spaced apart from the first vertical axis. The first and second arrays each include a single radiating element per horizontal row.

In some embodiments, a horizontal distance between the first vertical axis and the second vertical axis is between 0.1 and 0.5 wavelengths of a center frequency of an operating frequency band of the first radiating elements. In embodiments where the operating frequency band for the first radiating elements is within the 1.7-2.7 GHz frequency band, the horizontal distance between the first vertical axis and the second vertical axis may, for example, be between 20-75 mm. In some embodiments, a boresight pointing direction for the first of the first radiating elements may not intersect a longitudinal axis that extends through the center of the RF lens structure.

Reference is now made to FIG. 1A, which is a schematic top view of a lensed base station antenna 10. Base station antenna 10 includes a conventional linear array 12 of radiating elements 14 that are aligned along the same vertical axis (only the top radiating element 14 is visible in FIG. 1A). The linear array 12 generates an antenna beam 18 that is injected into a cylindrical RF lens 16 that focuses the antenna beam 18. The RF lens 16 will focus an incident RF signal more as the frequency of the incident RF signal increases, since the focusing increases as a function of the number of wavelengths that an RF signal cycles through in passing through the RF lens 16, and hence the RF lens 16 will focus higher frequency RF signals that pass through the RF lens 16 more than lower frequency RF signals.

Figure 1B:
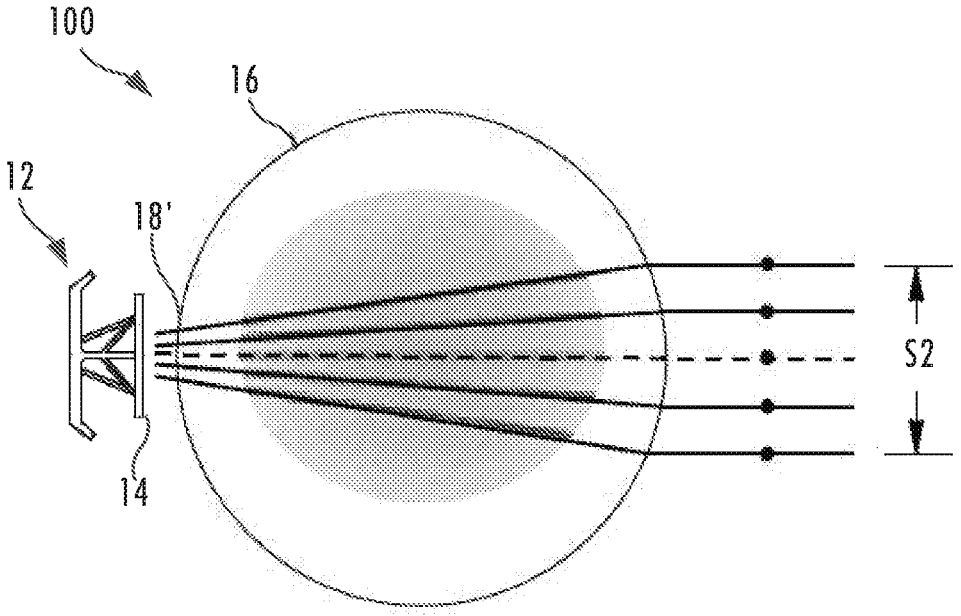

However, the extent to which the RF lens 16 will focus an antenna beam incident thereto is not only a function of the frequency of the RF signal, but also is a function of how much of the RF lens 16 is illuminated by the incident antenna beam. As shown in FIG. 1A, if an antenna beam 18 having a relatively wide azimuth beam width is injected into RF lens 16, the antenna beam 18 will illuminate most of the RF lens 16. In contrast, as shown in FIG. 1B, if an antenna beam 18' that has a somewhat smaller azimuth beam width is injected into the RF lens 16, then the antenna beam 18' will illuminate less of the RF lens 16, and hence will be focused less by the RF lens 16 than will antenna beam 18, all else being equal. Accordingly, if the linear array 12 of radiating elements 14 may be designed to generate antenna beams that have azimuth beam widths that vary as a function of frequency in a manner opposite to how the RF lens 16 varies the azimuth beam width as a function of frequency, then lensed base station antennas may be provided that have a relatively stable azimuth beamwidth as a function of frequency.

The azimuth beam width of an antenna beam generated by, for example, a two column array of radiating elements will vary as a function of frequency, as the horizontal spacing between the two columns, in terms of wavelength, will be greater the higher the frequency. As such, the beam width in the azimuth plane of antenna beams generated by the two column array will vary with frequency. The staggered vertical arrays included in base station antennas according to embodiments of the present invention effectively operate in the same manner as the above-described two column array. In particular, because the distance (in terms of wavelength) between the radiating elements that are positioned along different vertical axes increases with increasing frequency, the azimuth beam width of the antenna beam that is injected into the RF lens 16 will decrease with increasing frequency. If the ratio of the electric field aperture S1 of the antenna beam 18 illuminating the RF lens 16 at a first frequency f1 at the lower end of the operating frequency band (e.g., 1.7 GHz) to the electric field aperture S2 of the antenna beam 18' illuminating the RF lens 16 at a second frequency f2 that is at the upper end of the operating frequency band (e.g., 2.7 GHz) is about equal to the ratio of the frequency f1 to the frequency f2, then azimuth beam width stability may be achieved. Thus, by staggering some of the radiating elements in the horizontal direction, the extent to which the array 12 illuminates the RF lens 16 becomes variable as a function of frequency, thereby offsetting the frequency-dependent effect that the RF lens 16 has on the azimuth beam width.

Embodiments of the present invention will now be discussed in further detail with reference to the drawings, in which example embodiments are shown.

Figure 2:
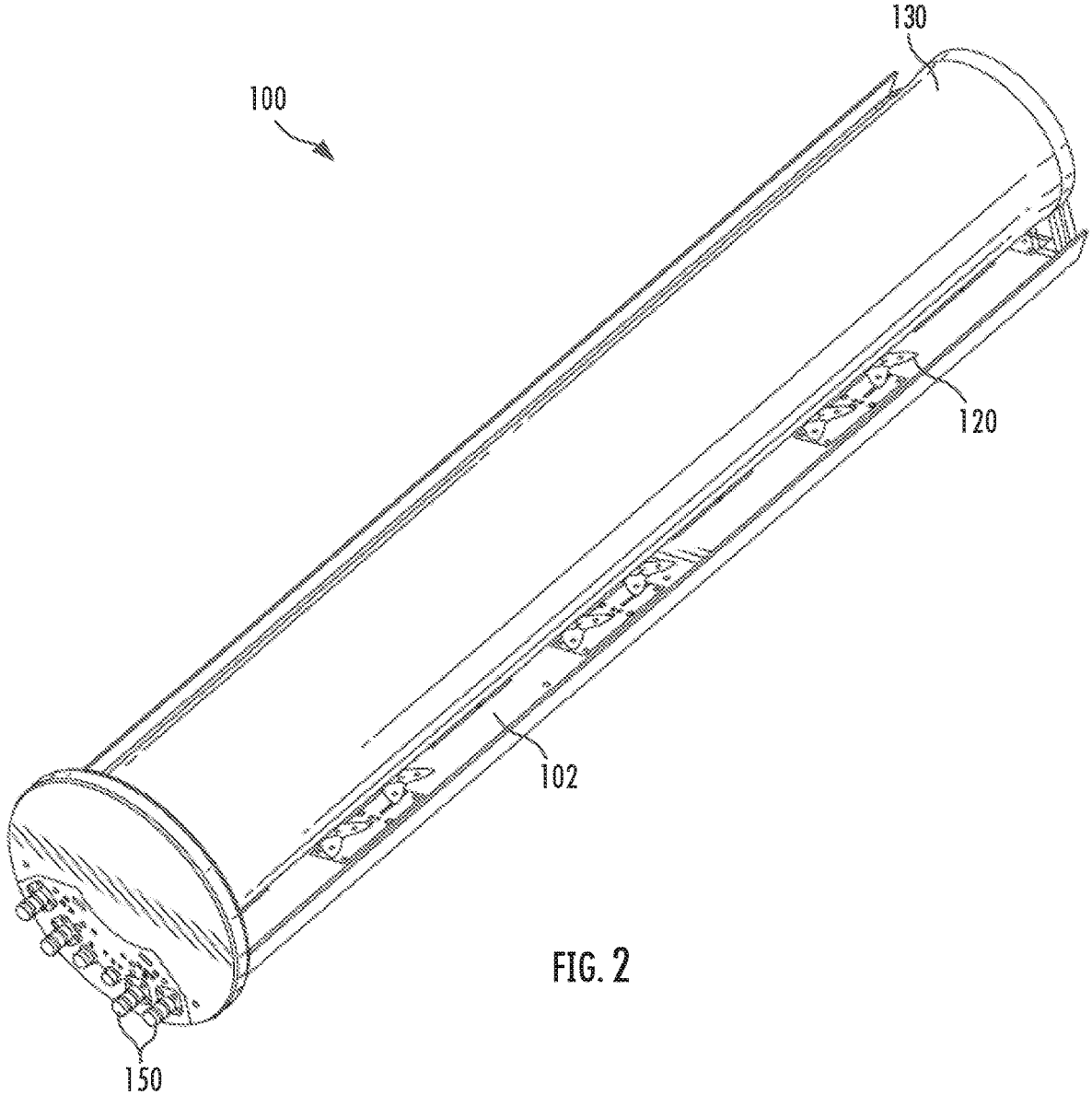
FIG. 2 is a perspective view of a lensed multi-beam base station antenna according to embodiments of the present invention with the radome removed.
Figure 3:
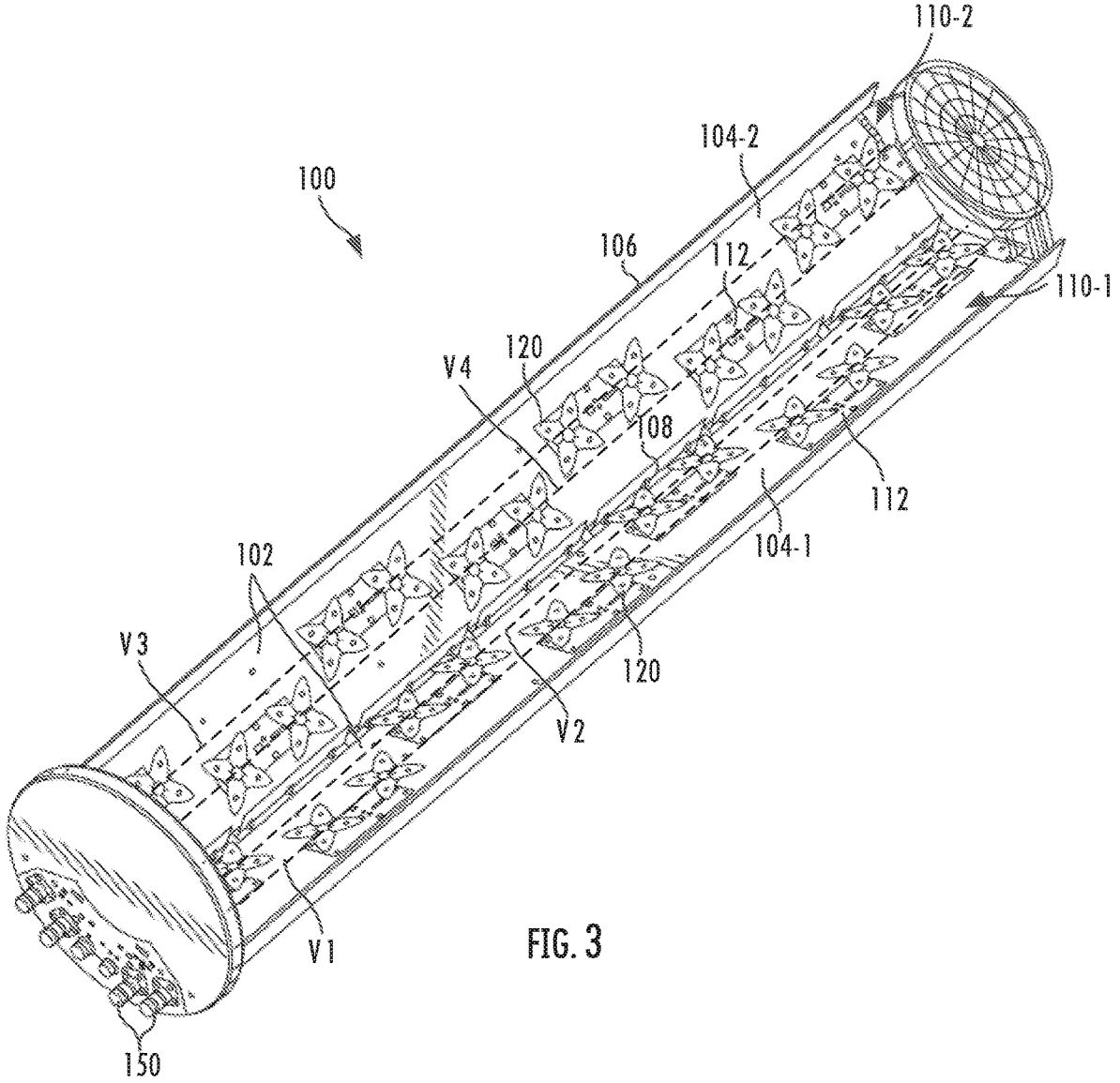
FIG. 3 is a perspective view of the lensed multi-beam base station antenna of FIG. 2 with the RF lens structure thereof also removed.
Figure 4:
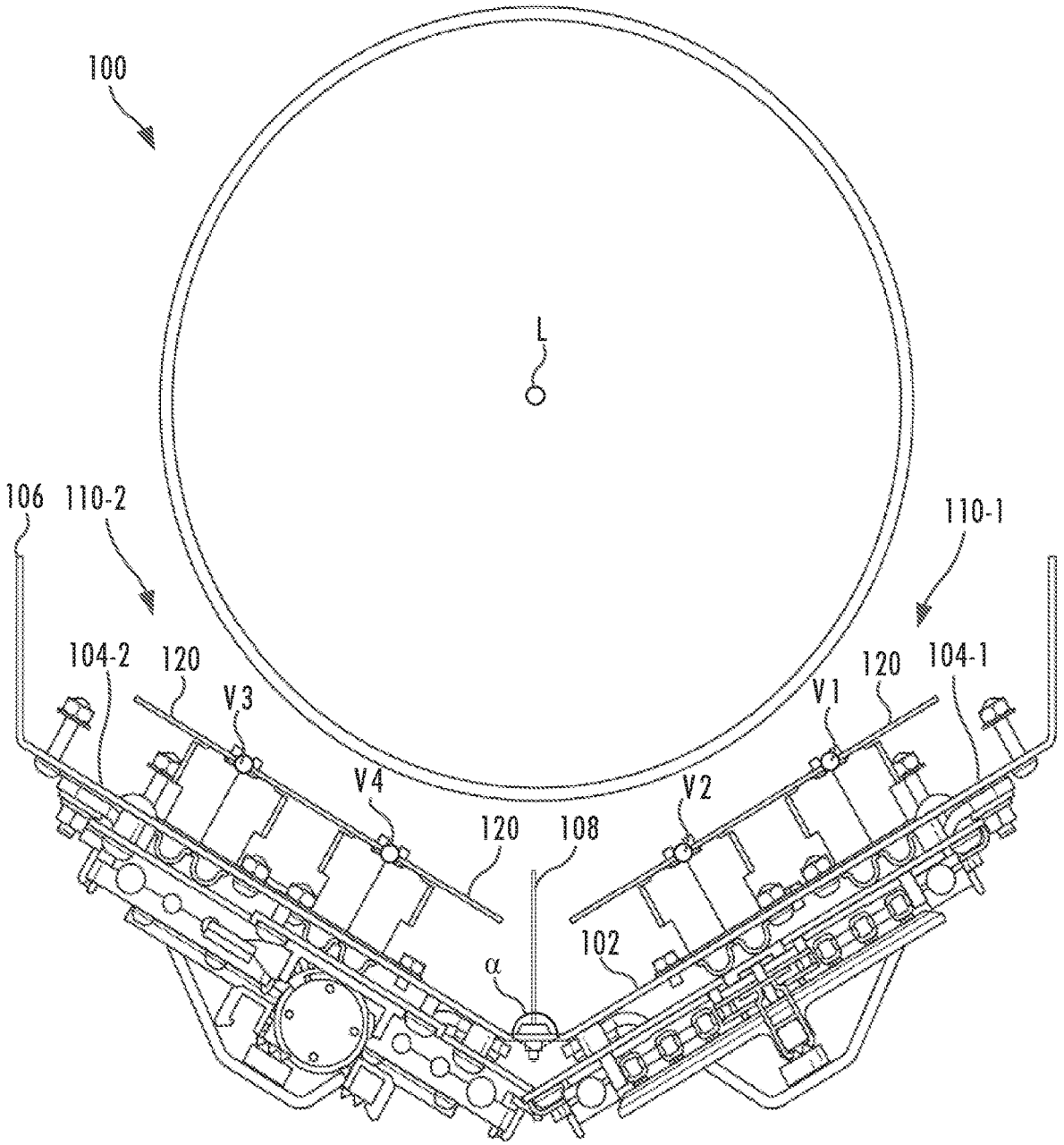
FIG. 4 is a cross-sectional view of the lensed multi-beam base station antenna of FIG. 2.
Figure 13:
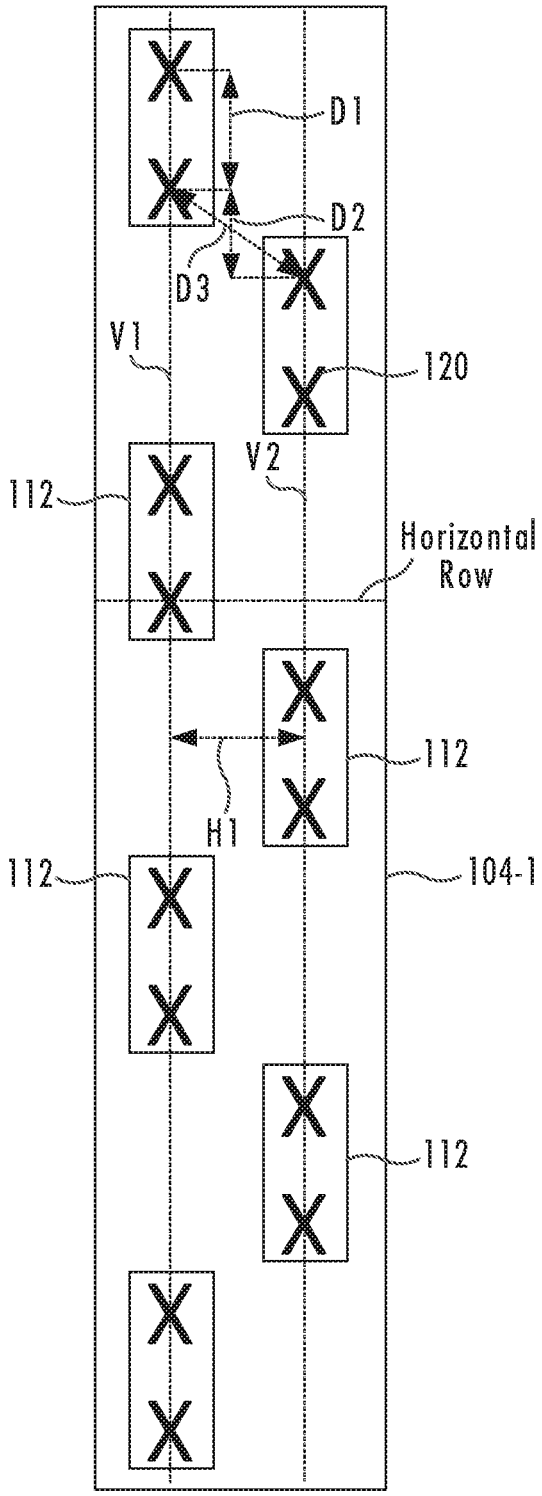
FIG. 13 is a schematic front view of one of the staggered vertical arrays of radiating elements included in the base station antenna of FIGS. 2-4.

Reference is now made to FIGS. 2-4, which illustrate a lensed multi-beam base station antenna 100 according to some embodiments of the present invention with the radome thereof removed. In particular, FIG. 2 is a perspective view of the lensed multi-beam base station antenna 100, while FIG. 3 is a perspective view of the lensed multi-beam base station antenna 100 of FIG. 2 with the RF lens structure also removed to better illustrate the staggered vertical arrays of radiating elements included in the antenna 100. FIG. 4 is a cross-sectional view of the lensed multi-beam base station antenna 100. FIG. 13 is a schematic front view of one of the staggered vertical arrays of radiating elements included in the antenna 100.

The lensed multi-beam base station antenna 100 includes a generally V-shaped reflector 102 that includes first and second reflector panels 104-1, 104-2. The reflector panels 104 may each be generally planar panels. The reflector 102 may further include a pair of sidewalls 106 that extend forwardly from outer edges of the respective reflector panels 104. The reflector 102 may further include an isolation wall 108 that extends forwardly from a central portion of the reflector 102.

The lensed multi-beam base station antenna 100 may also include first and second staggered vertical arrays 110-1, 110-2 of radiating elements 120. As noted above, a "staggered vertical array" refers to an array of radiating elements in which the radiating elements are spaced apart from one another in the vertical direction with at least some of the radiating elements staggered in the horizontal direction with respect to other of the radiating elements by a relatively small distance. As shown best in FIGS. 3 and 13, the staggered vertical array 110-1 includes a plurality of radiating elements 120 that are vertically spaced apart from one another, and the radiating elements 120 are vertically aligned along two spaced-apart vertical axes V1 and V2. Similarly, staggered vertical array 110-2 includes a plurality of radiating elements 120 that are vertically spaced apart from one another, and the radiating elements 120 are vertically aligned along two additional spaced-apart vertical axes V3 and V4. With the exception of the radiating elements 120 at either end of each staggered vertical array 110, each radiating element 120 in each array 110 is vertically adjacent to one radiating element 120 that is aligned on the same vertical axis and one radiating element 120 that is aligned along an adjacent vertical axis.

The staggered vertical arrays 110-1, 110-2 may be mounted to extend forwardly from the respective reflector panels 104-1, 104-2. The reflector panels 104-1, 104-2 may be formed from a unitary piece of metal or may comprise multiple different pieces. As is shown best in FIG. 4, the reflector panels 104-1, 104-2 may define a pair of planes that meet at an oblique angle α. The oblique angle α may be an angle that is between 100° and 140° in some embodiments. For example, the oblique angle α may be an angle of about 120° in some embodiments.

As shown best in FIGS. 3 and 13, the radiating elements 120 may be mounted on feed boards 112, such that two (or more) radiating elements 120 have feed components in common. The feed boards 112 may be mounted forwardly of the reflector 102 in some embodiments. In the depicted embodiment, each staggered vertical array 110 includes a total of fourteen radiating elements 120 (only thirteen of which are visible in FIG. 3), and two radiating elements 120 are mounted on each feed board 112. Since all of the radiating elements 120 are vertically spaced apart from one another, each staggered vertical array 110 includes a total of fourteen rows, with a single radiating element 120 included in each row, as can best be seen in FIG. 13. As can also be seen in FIG. 13, the base station antenna 100 is configured so that a first subset of the feed boards 112 are aligned along the first vertical axis V1 and a second subset of the feed boards 112 are aligned along the second vertical axis V2. Other embodiments of the present invention have different feed board arrangements, as discussed below.

Each radiating element 120 may be, for example, a dual polarized (cross-dipole) radiating element that includes a first dipole radiator that is angled at −45° with respect to a longitudinal (vertical) axis of the antenna 100 and a second dipole radiator that is angled at +45° with respect to the longitudinal axis of the antenna 100. Thus, each staggered vertical array 110 may simultaneously transmit two RF signals, namely a first RF signal that has a first polarization that is transmitted through the −45° dipole radiators of the radiating elements 120 and a second RF signal that has a second, orthogonal polarization that is transmitted through the +45° dipole radiators of the radiating elements 120.

The lensed multi-beam base station antenna 100 may include a plurality of RF ports 150. When the radiating elements 120 are implemented as dual-polarized radiating elements, two ports 150 may be provided for each staggered vertical array 110 to supply RF signals at each polarization to each staggered vertical array 110-1, 110-2. Moreover, the radiating elements 120 may be wideband radiating elements that are configured to transmit signals in two or more different frequency bands such as, for example, two different frequency bands within the 1.7-2.7 GHz frequency range. When wideband radiating elements 120 are used, diplexing may be performed either in the antenna 100 or in the radios that are connected to the antenna 100. If diplexing is performed in the radios, then the antenna 100 may have four RF ports 150, namely an RF port 150 for each of two polarizations for each staggered vertical array 110, and the RF signals in both frequency bands are passed through each RF port 150. If diplexing is instead performed in the antenna 100, then each RF port 150 may only receive RF signals in a single frequency band from the respective attached radios, and hence a total of eight RF ports 150 would be included in antenna 100 in this configuration.

As noted above, each staggered vertical array 110 may simultaneously transmit first and second RF signals. The first RF signal being transmitted through the −45° dipole radiators of the radiating elements 120 and the second RF signal being transmitted through the +45° dipole radiators of the radiating elements 120. The first RF signal may be input to antenna 100 through a first of the RF ports 150, and a first feed network (not shown) may, for example, split the first RF signal into seven sub-components that are fed to the seven feed boards 112 included in the staggered vertical array 110-1. Each feed board 112 may include a 1×2 power divider (not shown) for the −45° dipole radiators that further sub-divides the sub-component of the first RF signal that is input to the respective feed board 112. The outputs of each 1×2 power divider (not shown) for the −45° dipole radiators are coupled to the respective −45° dipole radiators of the two radiating elements 120 that are mounted on each feed board 112. Similarly, the second RF signal may be input to antenna 100 through a second of the RF ports 150, and a second feed network (not shown) may, for example, split the second RF signal into seven sub-components that are fed to the seven feed boards 112 included in the staggered vertical array 110-1. Each feed board 112 may also include a 1×2 power divider for the +45° dipole radiators that further sub-divides the sub-component of the second RF signal that is input to the respective feed board 112. The outputs of each 1×2 power divider for the +45° dipole radiators are coupled to the respective +45° dipole radiators of the two radiating elements 120 that are mounted on each feed board 112.

While not shown in the drawings, the first and second feed networks may each further include an electronic or electro-mechanical phase shifter that applies a phase taper to, for example, the seven sub-components of the respective first and second RF signals. The phase tapers may be adjusted by changing the settings on the respective phase shifters in order to vary a downtilt angle of the antenna beams generated by the respective first and second RF signals.

Staggered vertical array 110-2 may be configured identically to staggered vertical array 110-1, and hence further description thereof will be omitted.

As shown in FIGS. 2 and 4, the lensed base station antenna 100 also includes an RF lens structure 130. The RF lens structure 130 may comprise, for example, one or more dielectric RF lenses. In the depicted embodiment, the RF lens structure 130 is implemented using a single, vertically extending cylindrical RF lens 130. In an example embodiment, the RF lens structure 130 may be formed of a material having a homogeneous dielectric constant that focuses the RF energy. In other embodiments, the RF lens structure 130 may comprise a Luneburg lens that has concentrically arranged layers of dielectric materials that have varying indexes of refraction. The RF lens structure 130 may be formed, for example, using any of the lens materials disclosed on U.S. Patent Publication No. 2017/0279202, the entire content of which is incorporated herein by reference. The RF lens structure 130 may be a homogeneous lens in some embodiments, and may include one or more RF lenses. When the RF lens structure 130 includes multiple RF lenses, the RF lenses may be, for example, cylindrical, spherical or ellipsoidal shaped RF lenses.

The antenna 100 may comprise a dual beam wideband antenna. In operation, the RF lens structure 130 narrows the HPBW of the antenna beams generated by each of the staggered vertical arrays 110-1, 110-2, and therefore increases the gain of these antenna beams. For example, the RF lens structure 130 may narrow the HPBW of the resulting antenna beams to be about 33°. The staggered vertical arrays 110 of radiating elements 120 may be configured to inject RF signals into the RF lens structure 130 at different angles to generate side-by-side antenna beams that may together provide coverage to a 120° sector. It should be noted that the antennas according to embodiments of the present invention may be used in applications other than sector-splitting such as, for example, in venues such as stadiums, coliseums, convention centers and the like. In such applications, the multiple beams are more usually configured to cover a 60°-90° sector.

As discussed above, the radiating elements 120 may be designed to generate antenna beams that have a relatively stable azimuth beam width over the operating frequency range for the radiating elements 120, while the RF lens structure 130 will focus higher frequency RF signals in the azimuth plane more than lower frequency RF signals. Consequently, a lensed base station antenna that includes conventional linear arrays of radiating elements may have poor azimuth beam width stability, particularly if the antenna is designed to operate over a large frequency range. The base station antenna 100 may exhibit improved azimuth beam width stability since staggered vertical arrays 110 are used, as the staggered vertical arrays 110 generate relatively narrow antenna beams at higher frequencies that only illuminate a portion of the RF lens 130, and hence are not as highly focused by the RF lens structure 130 as are the antenna beams generated by the staggered vertical arrays 110 at lower frequencies that illuminate a larger portion of the RF lens and hence are focused more heavily by the RF lens structure 130.

The staggered vertical array 110-1 generates an antenna beam that is narrower in the azimuth plane which leads to less illumination at the edges of the RF lens structure 130. The illumination taper at the edges of the RF lens structure 130 increases as the azimuth HPBW of the antenna beam injected into the RF lens structure 130 decreases. If, for example, conventional vertical linear arrays were used in antenna 100 instead of the staggered vertical arrays 110, then the angle subtended by the RF lens structure 130 may be much smaller than the azimuth HPBW of the conventional vertical linear array. So even though the HPBW of the conventional vertical linear array may narrow with increasing frequency, the change in taper at the edges of the RF lens structure 130 may only increase from, for example, perhaps 0.2 dB at the lowest frequency to 0.5 dB at the highest frequency in the operating frequency band. But with the staggered vertical arrays 110 included in the antennas according to embodiments of the present invention, there is already a taper at the edges of the RF lens structure 130 at the lowest frequency and since the beam pattern roll-off is nominally parabolic in shape, the rate of roll-off increases as the roll-off value increases. So if the roll-off is 2 dB at the lowest frequency then it might be 5 dB at the highest frequency. Since stabilization of the azimuth HPBW of the antenna beam exiting the RF lens structure 130 depends on a larger change in the taper across RF lens structure 130 with increasing frequency, antennas implemented with staggered vertical arrays will display improved azimuth HPBW stability. Also note that while the magnification efficiency (shrinkage of the azimuth HPBW) decreases as the taper increases (the lens is less efficiently used), at the low end of the frequency band the inclusion of the stagger means that the starting azimuth HPBW (before the lens) is already narrower, so the end result is that even with some taper the azimuth HPBW after the RF lens structure is still narrower than the case where no stagger is used. With sufficiently wide stagger the azimuth HPBW after the lens could be made nearly constant with respect to frequency over a fairly broad band. However at some point the stagger becomes large enough that the right "column" of the left staggered vertical array 110 may start coupling to the left "column" of the right staggered vertical array 110.

Thus, while an RF lens will more heavily focus a high frequency RF signal than it will a low frequency RF signal, since the base station antenna 100 is designed so that the antenna beam generated by the high frequency RF signal illuminates a smaller portion of the RF lens structure 130 than does the antenna beam generated by the low frequency RF signal, the RF lens structure 130 will perform less focusing on the antenna beam generated by the high frequency RF signal since the RF lens structure 130 is effectively a smaller RF lens for this RF signal. Accordingly, the overall effect of the RF lens structure 130 may be relatively independent of frequency, providing improved azimuth beam width stability.

Figure 5A:
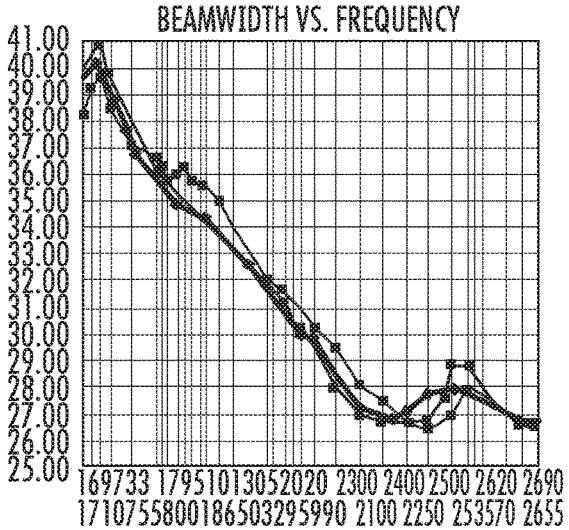
FIGS. 5A-5C are a series of graphs that illustrate the improvement in azimuth beam width stability that can be achieved by using staggered vertical arrays according to embodiments of the present invention
Figure 5A:
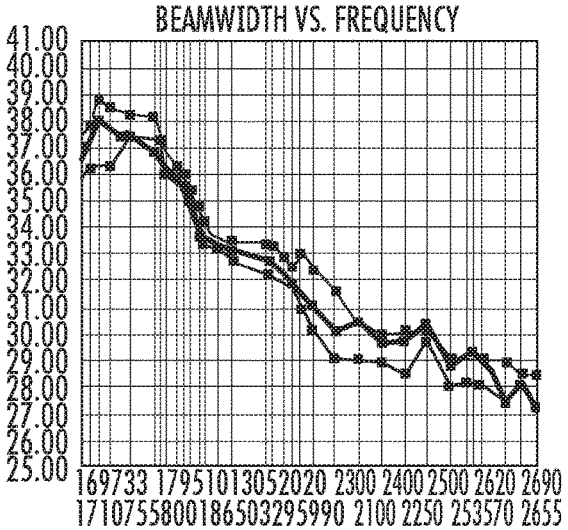
Figure 5B:
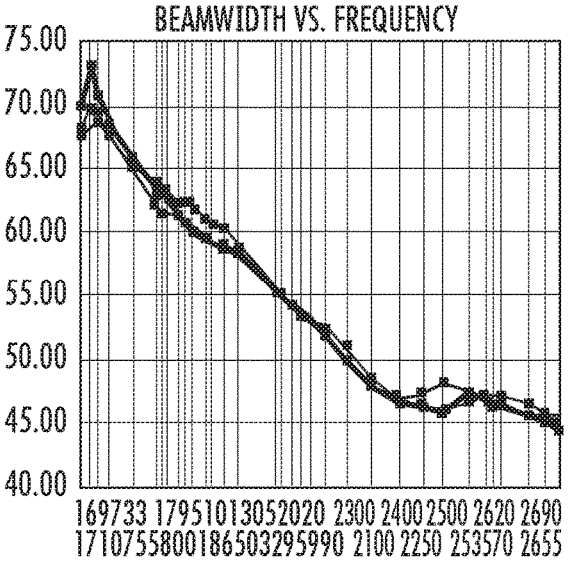
Figure 5B:
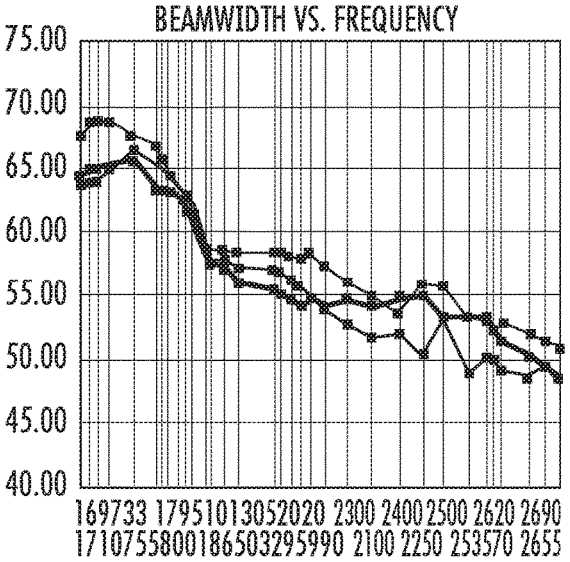
Figure 5C:
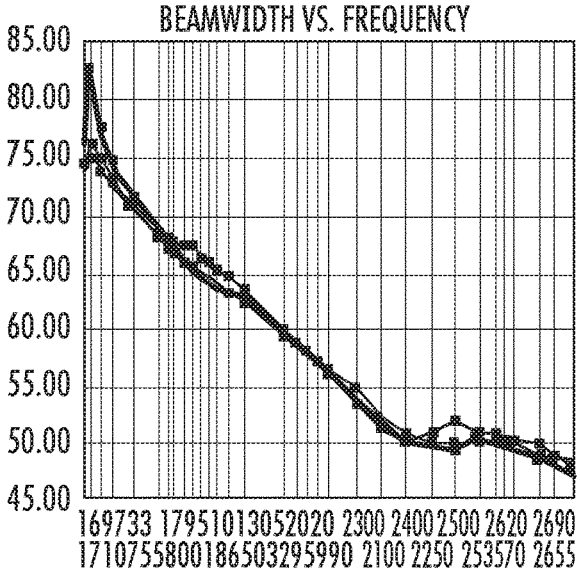
Figure 5C:
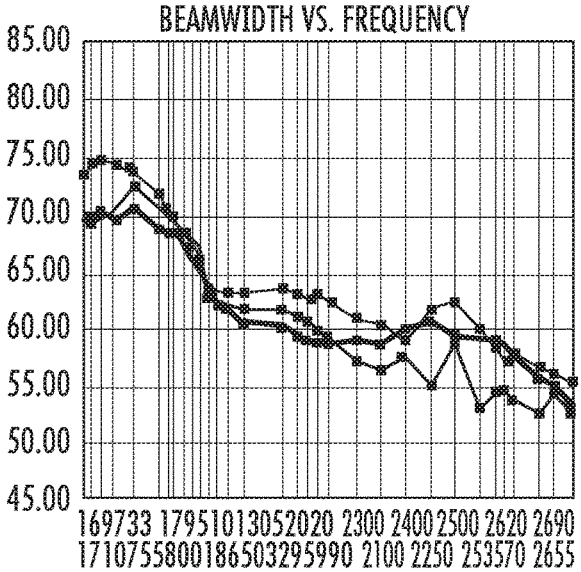

FIGS. 5A-5C are a series of graphs that illustrate the improvement in azimuth beam width stability that can be achieved by using the staggered vertical arrays according to embodiments of the present invention in place of conventional linear arrays in a sector-splitting lensed base station antenna. In particular, FIGS. 5A-5C illustrate the improvement in 3 dB, 10 dB and 12 dB azimuth beam width stability that may be achieved in an example embodiment by using staggered vertical arrays. The improved azimuth beam width stability provides better cross-over performance.

Figure 6:
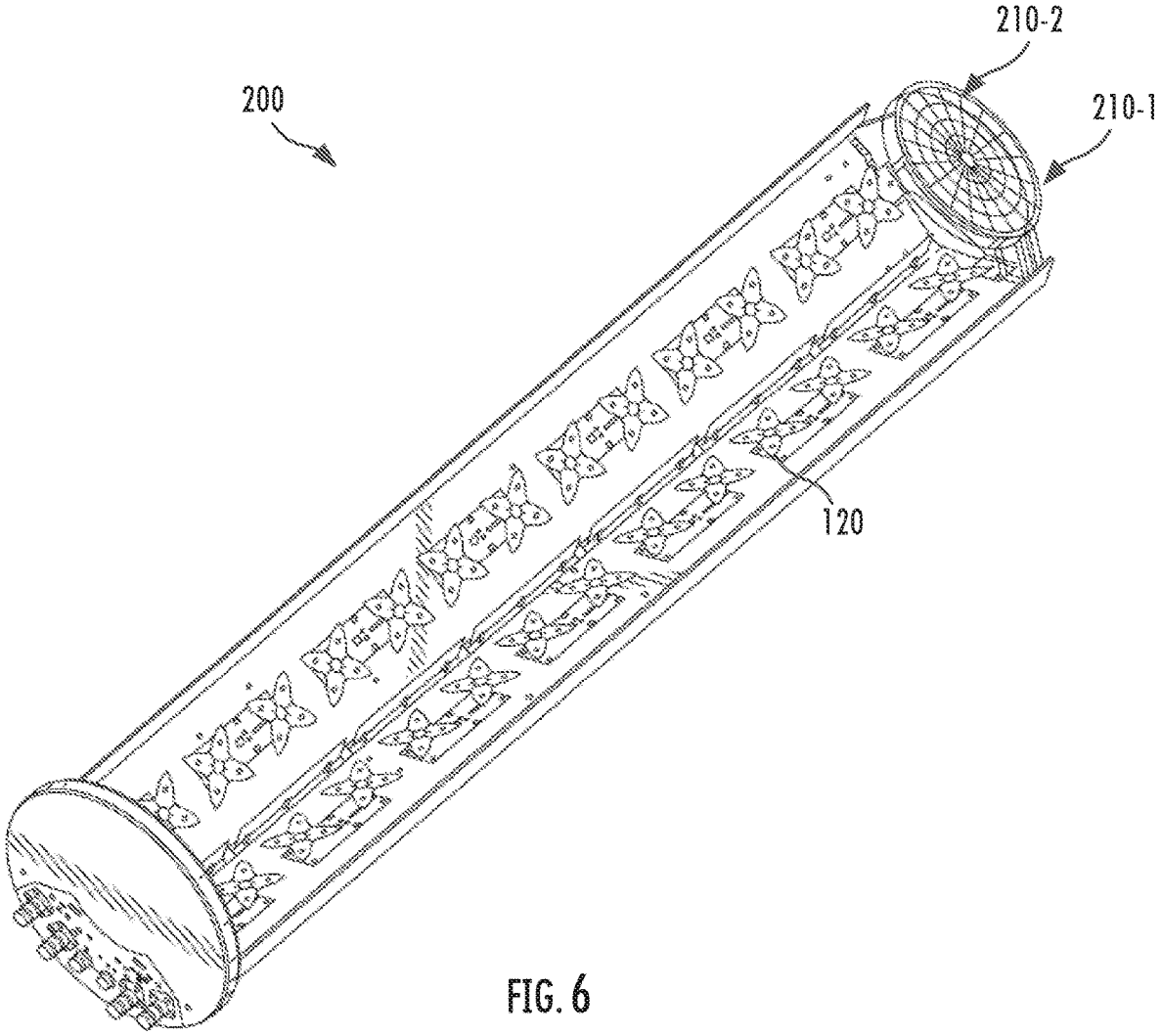
FIG. 6 is a schematic perspective view of a lensed base station antenna that is similar to the antenna of FIGS. 2-4 except that the antenna of FIG. 6 includes conventional linear arrays of radiating elements.

Referring first to FIG. 5A, the graph on the left side of FIG. 5A illustrates the measured 3 dB azimuth beam width as a function of frequency across the 1.7-2.7 GHz frequency range for a lensed base station antenna 200 that is a modified version of the lensed base station antenna 100 that includes conventional linear arrays 210. FIG. 6 is a schematic perspective view of the antenna 200 with the radome and RF lens removed that illustrates the conventional linear arrays 210 included therein. As shown in the graph on the left side of FIG. 5A, the measured 3 dB azimuth beam width for the antenna 200 that includes a conventional linear array design varied from 26°-41° over the 1.7-2.7 GHz range, with the azimuth beam width for 84% of the frequency range being within an 8.6° range. The graph on the right side of FIG. 5A illustrates the measured 3 dB azimuth beam width as a function of frequency across the 1.7-2.7 GHz frequency range for the lensed base station antenna 100 according to embodiments of the present invention. As shown in the graph on the right side of FIG. 5A, the measured 3 dB azimuth beam width for the lensed base station antenna 100 according to embodiments of the present invention varied from 26°-38° over the 1.7-2.7 GHz range, with the azimuth beam width for 84% of the frequency range being within a 6.0° range, or a 30% improvement.

Referring next to FIG. 5B, the graph on the left illustrates the measured 10 dB azimuth beam width as a function of frequency across the 1.7-2.7 GHz frequency range for the antenna 200, while the graph on the right illustrates the measured 10 dB azimuth beam width as a function of frequency across the 1.7-2.7 GHz frequency range for the lensed base station antenna 100 according to embodiments of the present invention. As shown in the graph on the left side of FIG. 5B, the measured 10 dB azimuth beamwidth for the antenna 200 that includes a conventional linear array design varied from 44°-73° over the 1.7-2.7 GHz range, with the azimuth beam width for 84% of the frequency range being within a 17° range. In contrast, as shown in the graph on the right side of FIG. 5B, the measured 10 dB azimuth beam width for the lensed base station antenna 100 according to embodiments of the present invention varied from 48°-68° over the 1.7-2.7 GHz range, with the azimuth beam width for 84% of the frequency range being within a 11° range, or a 35% improvement.

Referring next to FIG. 5C, the graph on the left illustrates the measured 12 dB azimuth beam width as a function of frequency across the 1.7-2.7 GHz frequency range for the antenna 200, while the graph on the right illustrates the measured 12 dB azimuth beam width as a function of frequency across the 1.7-2.7 GHz frequency range for the lensed base station antenna 100 according to embodiments of the present invention. As shown in the graph on the left side of FIG. 5C, the measured 12 dB azimuth beam width for the antenna 200 that includes a conventional linear array design varied from 47°-84° over the 1.7-2.7 GHz range, with the azimuth beam width for 84% of the frequency range being within a 23° range. In contrast, as shown in the graph on the right side of FIG. 5C, the measured 12 dB azimuth beam width for the lensed base station antenna 100 according to embodiments of the present invention varied from 53°-75° over the 1.7-2.7 GHz range, with the azimuth beam width for 84% of the frequency range being within a 12° range, or a 48% improvement.

Referring again to FIG. 13, the vertical axes V1 and V2 are spaced apart by a horizontal distance H1. The vertical axes V3 and V4 will also typically be spaced apart by the same horizontal distance H1 as the vertical axes V1 and V2. In the base station antenna 100 that was used to generate the graphs shown in FIGS. 5A-5C, the horizontal distance H1 was set at 45 mm. In base station antennas according to embodiments of the present invention that operate in the 1.7-2.7 GHz frequency range, the horizontal distance H1 may be, for example, between 20-75 mm. It will be appreciated that the horizontal distance H1 that the vertical axes V1 and V2 are spaced apart by will vary as a function of the operating frequency of the radiating elements 120. Accordingly, in example embodiments of the present invention, the horizontal distance H1 (i.e., the separation between the vertical axes V1 and V2) may be between 0.1 and 0.5 wavelengths of the center frequency of an operating frequency band of the radiating elements 120. In other embodiments, the horizontal distance H may be between 0.1 and 0.35 wavelengths of the center frequency of an operating frequency band of the radiating elements 120.

Typically, the radiating elements in a lensed base station antenna are oriented so that a boresight pointing direction of the radiating element (which refers to the axis along which peak RF energy is emitted, which typically is an axis that extends from the center of a cross-dipole radiating element in a direction perpendicular to the plane defined by the cross-dipoles) extends through a vertical axis that extends though the center of the RF lens. However, the base station antenna 100 includes a generally planar reflector panel 104 for each staggered vertical array 110. Since the radiating elements 120 are staggered in the horizontal direction, the boresight pointing direction for all of the radiating elements 120 cannot point at a longitudinal axis that runs vertically through the center of the RF lens 130.

Figure 7:
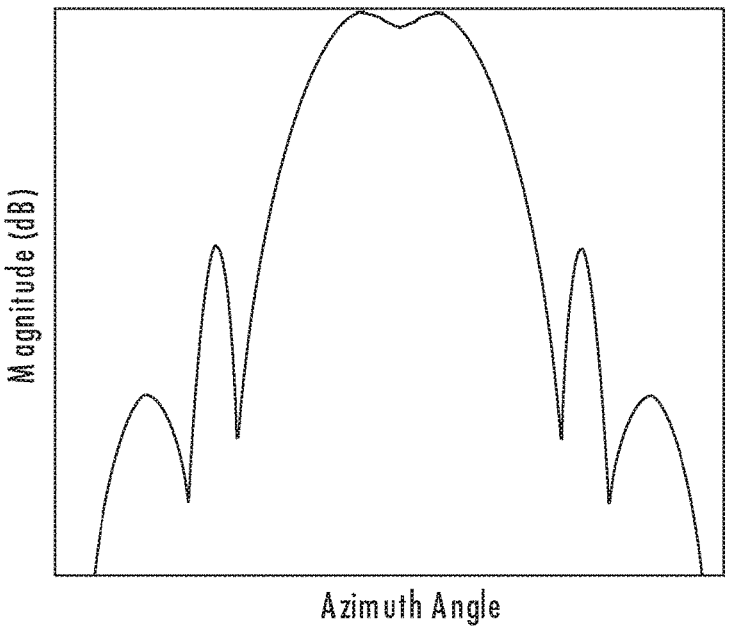
FIG. 7 is a schematic diagram of the azimuth pattern of an antenna beam generated by one of the staggered vertical arrays of the lensed base station antenna of FIGS. 2-4.

As shown in FIG. 4, in the base station antenna 100, the radiating elements 120 that are aligned along vertical axis V1 may point slightly to the right of a vertical axis L that extends through the center of RF lens 130, while the radiating elements 120 that are aligned along vertical axis V2 may point slightly to the left of the vertical axis L. As a result, the peak radiation emitted by staggered vertical array 110-1 may not be directed toward the vertical axis L that extends through the center of the RF lens 130, and thus the generated antenna beam has two peaks (in the azimuth plane) that are offset to either side of the vertical axis L. FIG. 7 is a schematic diagram of an azimuth cut of the antenna beam generated by staggered vertical array 110-1 (after the radiation passes through the RF lens 130). As can be seen in FIG. 7, two peaks are present in the azimuth pattern, one on either side of the center of the sub-sector. This results in a broad peak, which may be desirable in some applications.

Figure 8:
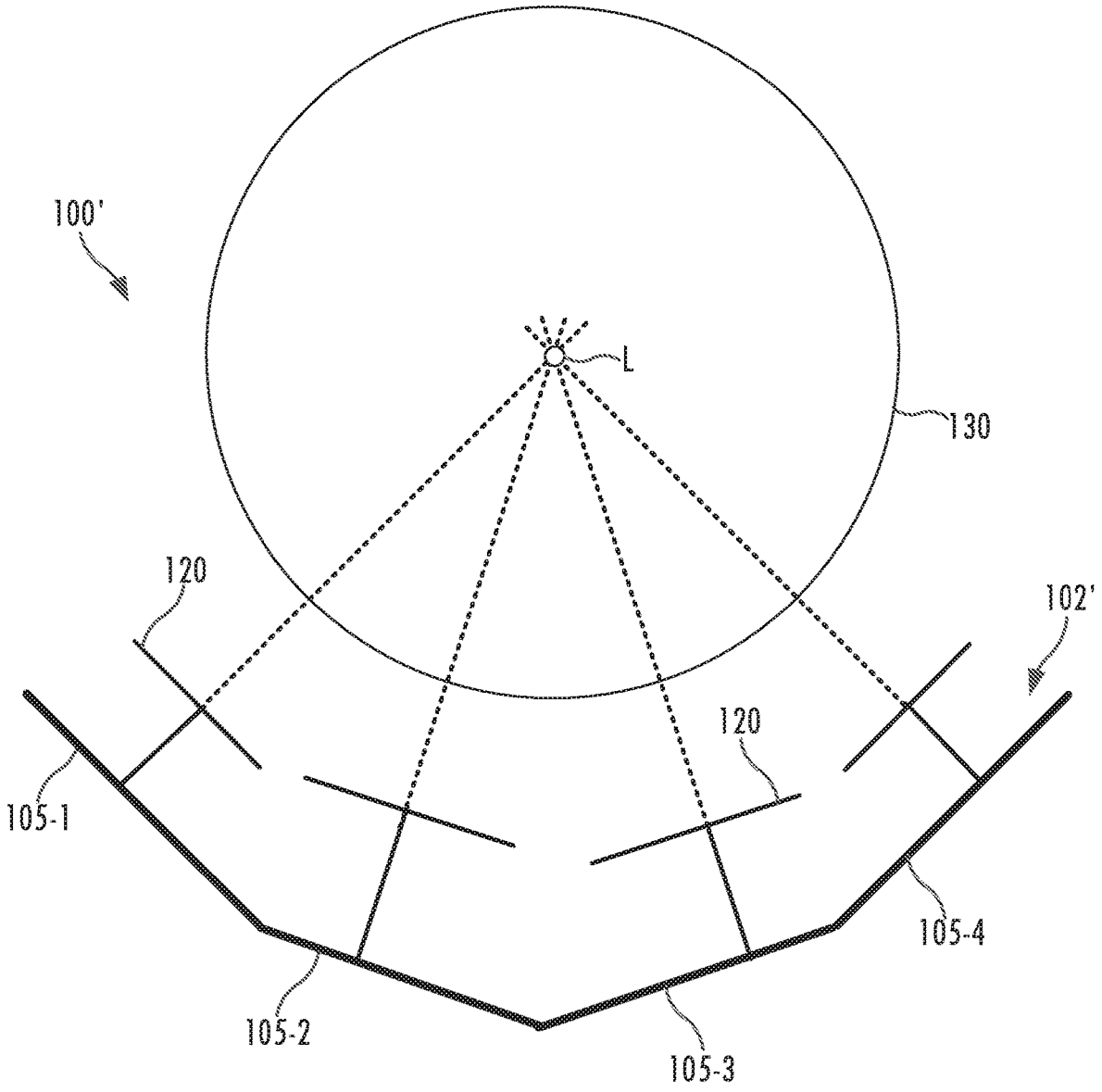
FIG. 8 is a schematic cross-sectional view of a modified version of the lensed multi-beam base station antenna of FIG. 2.

FIG. 8 is a schematic cross-sectional view of a modified version 100' of the lensed multi-beam base station antenna 100 which is configured so that the boresight pointing direction of each radiating element 120 passes through the vertical axis L that extends through the center of the RF lens 130. As shown in FIG. 8, this may be accomplished by replacing the reflector 102 of base station antenna 100 with the reflector 102' shown in FIG. 8. As can be seen in FIG. 8, the reflector 102' has a total of four reflector panels 105-1 through 105-4. Each reflector panel 105 is positioned so that the boresight pointing direction of the radiating elements 120 mounted thereon will pass through the longitudinal axis L of RF lens 130. This design will result in a more conventional antenna beam shape.

Figure 9:
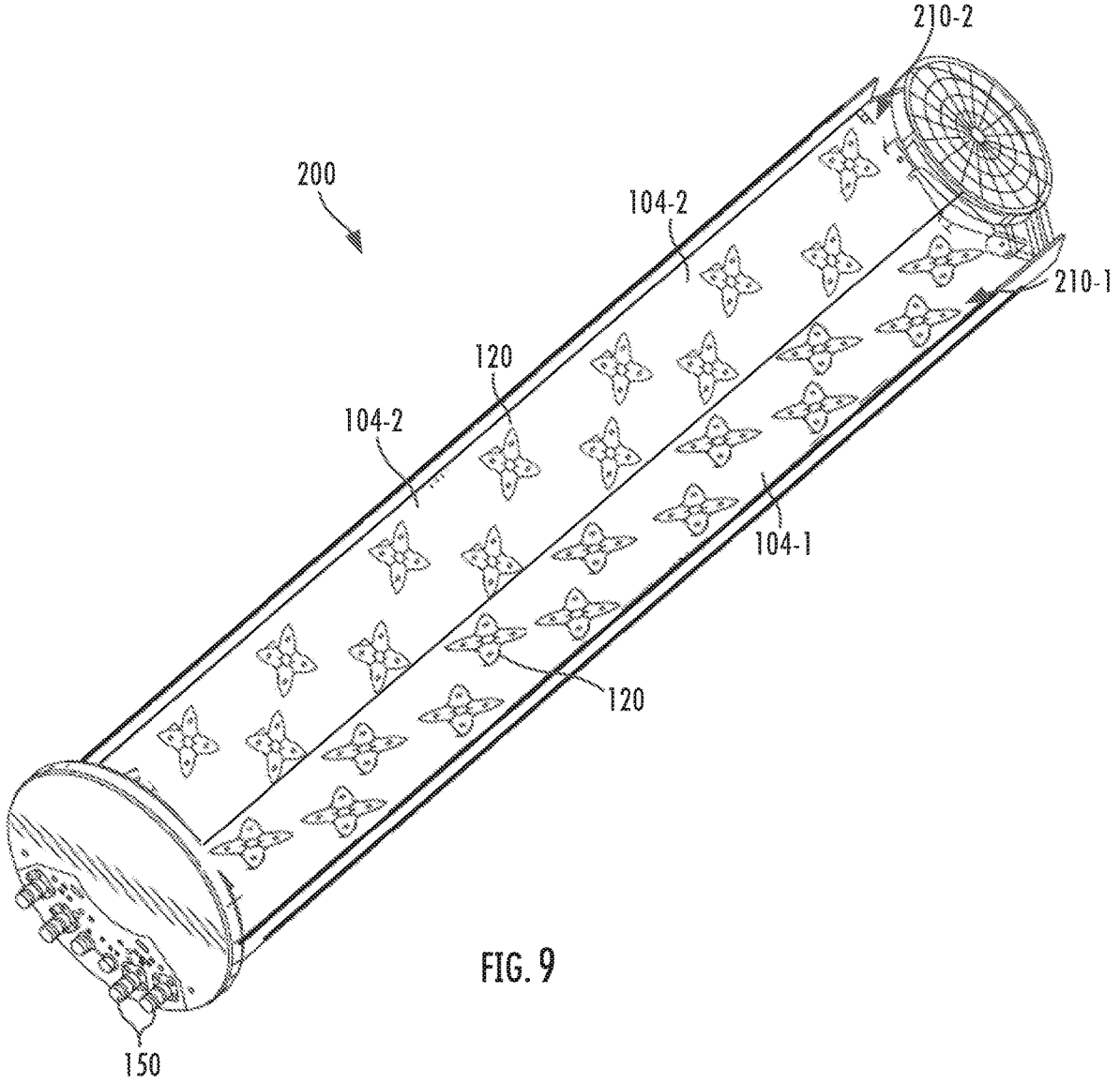
FIG. 9 is a schematic illustration of a lensed base station antenna that includes staggered vertical arrays that implement the stagger on an individual radiating element basis rather than on a feed board basis.

FIG. 9 is a schematic illustration of a lensed base station antenna 200 according to embodiments of the present invention (with the radome and RF lens structure thereof omitted). The lensed base station antenna 200 includes staggered vertical arrays that are staggered on an individual radiating element basis rather than on a feed board basis. As shown in FIG. 9, the lensed base station antenna 200 may be almost identical to the lensed base station antenna 100, except that in base station antenna 200 each radiating element 120 is mounted on an individual feed board, whereas in base station antenna 100 two radiating elements 120 are mounted on each feed board 112.

Figure 10:
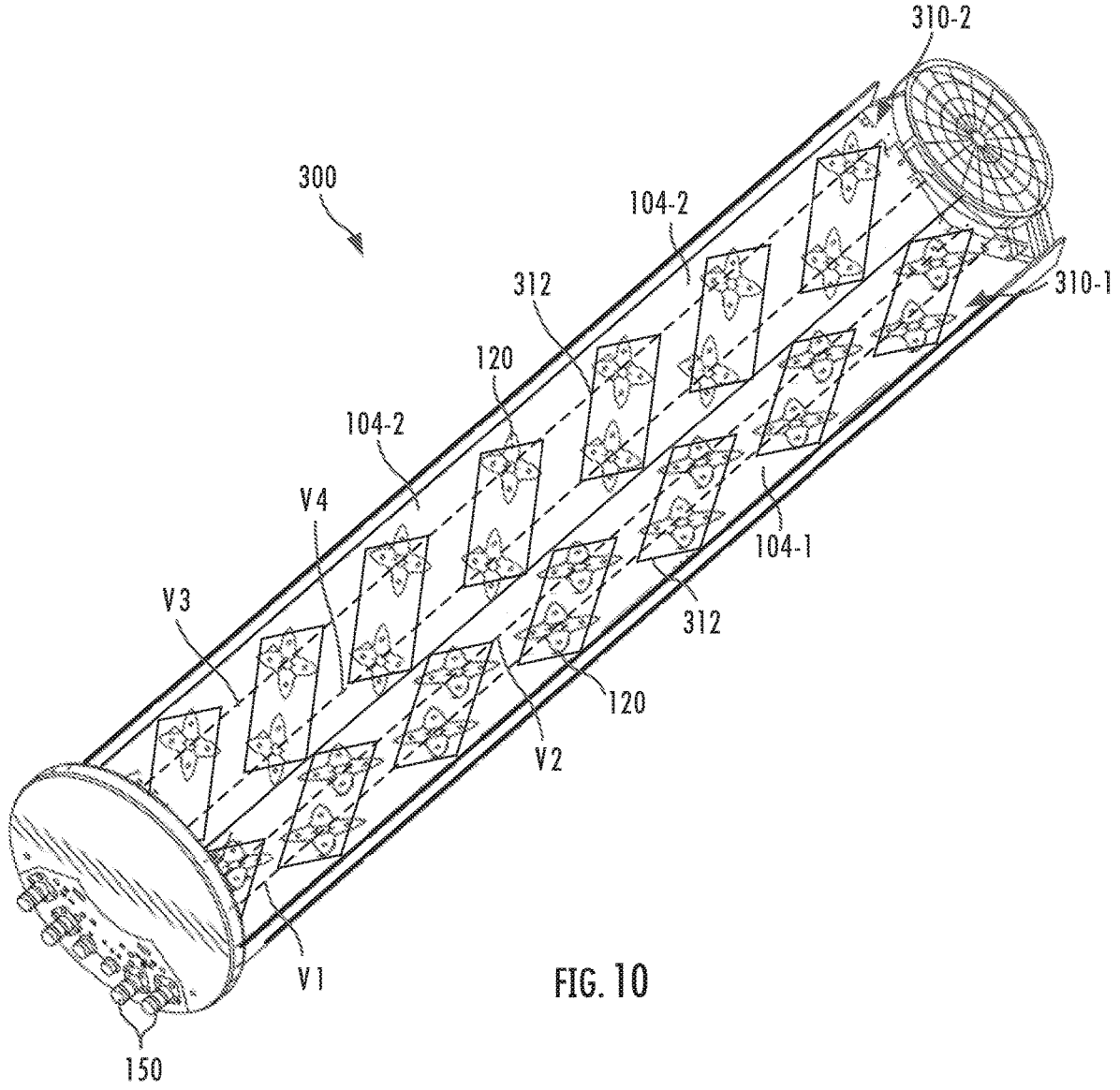
FIG. 10 is a schematic front view of a lensed base station antenna according to further embodiments of the present invention.

FIG. 10 schematically illustrates another lensed base station antenna 300 according to embodiments of the present invention. In FIG. 10, the RF lens structure (which may be identical to the RF lens structure 130 illustrated in FIGS. 2 and 4) and radome are removed to illustrate the two staggered vertical arrays 310-1, 310-2 included in antenna 300. As shown in FIG. 10, staggered vertical array 310-1 includes radiating elements 120 that are aligned along two spaced apart vertical axes V1 and V2, and staggered vertical array 310-2 includes radiating elements 120 that are aligned along two spaced apart vertical axes V3 and V4. The antenna 300 includes feed boards 312 that are extended in length and rotated 45° as compared to the feed boards 112 of lensed base station antenna 100. Consequently, each feed board 312 in staggered vertical array 310-1 includes a first radiating element 120 that is aligned along vertical axis V1 and a second radiating element 120 that is aligned along vertical axis V2. Similarly, each feed board 312 in staggered vertical array 310-2 includes a first radiating element 120 that is aligned along vertical axis V3 and a second radiating element 120 that is aligned along vertical axis V4.

Figure 11:
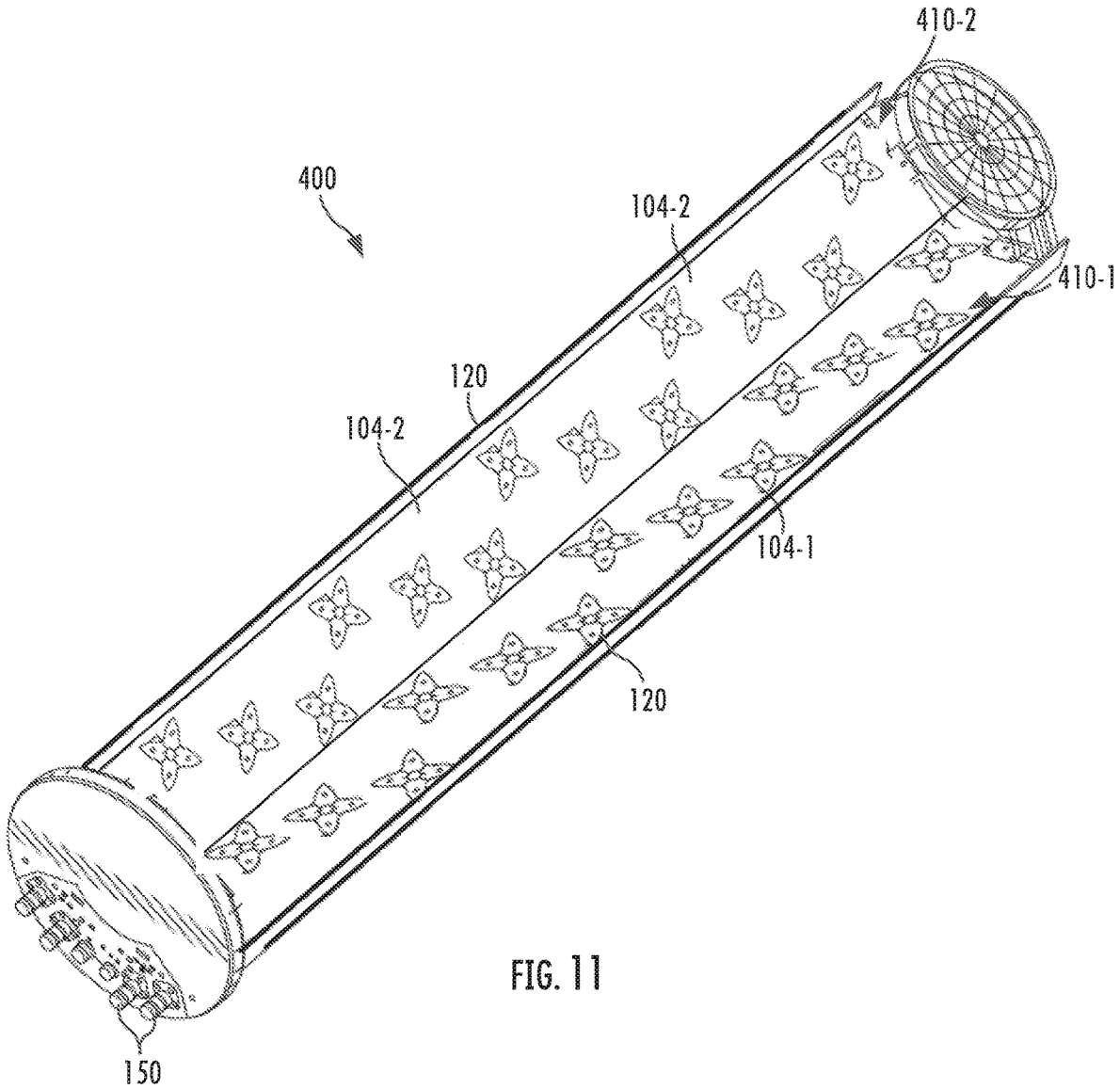
FIG. 11 is a schematic illustration of a lensed base station antenna according to embodiments of the present invention that includes a staggered array that locates the radiating elements along three different vertical axes.

FIG. 11 is a schematic illustration of a base station antenna 400 according to still further embodiments of the present invention that includes staggered vertical arrays 410 of radiating elements 120 that locate the radiating elements 120 along three different vertical axes. As can be seen, the base station antenna 400 may be very similar to the base station antenna 200, except that the radiating elements 120 are aligned along three different vertical axes instead of two. It will be appreciated that the radiating elements 120 may be aligned along any number of vertical axes.

The base station antenna 100 of FIGS. 2-4 includes a cylindrical RF lens 130 that extends for the entire length of the antenna 100. It will be appreciated, however, that a wide variety of different RF lenses may be used. For example, FIG. 12 is a schematic perspective view of a lensed base station antenna 500 according to some embodiments of the present invention that includes an array of ellipsoidal RF lenses 530.

Figure 12:
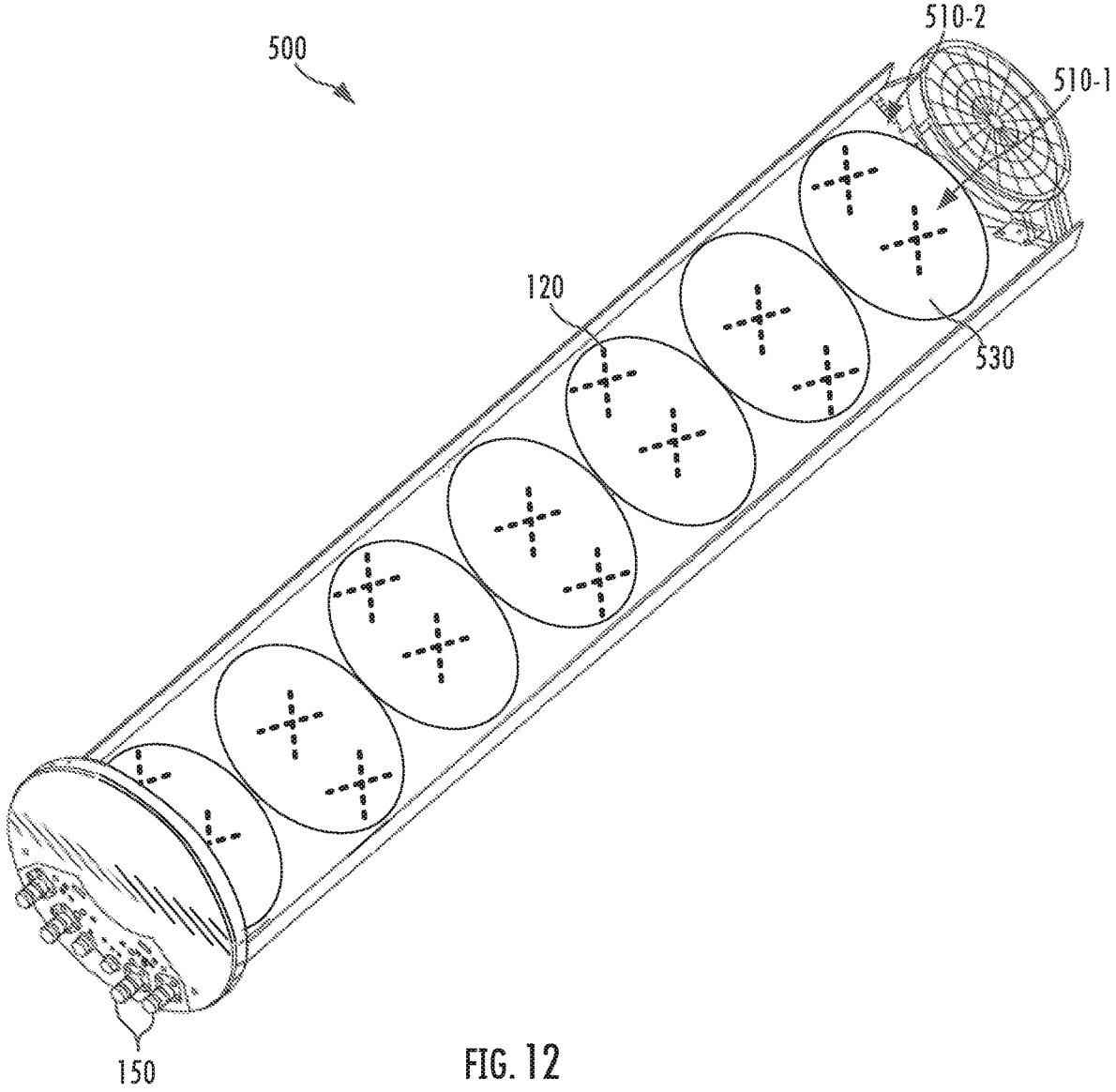
FIG. 12 is a schematic perspective view of a lensed base station antenna according to some embodiments of the present invention that includes an array of ellipsoidal RF lenses.

As shown in FIG. 12, the base station antenna 500 includes a total of seven ellipsoidal RF lenses 530. Typically, each staggered vertical array 510 included in base station antenna 500 would have a single radiating element 120 mounted behind each ellipsoidal RF lens 530, so the base station antenna 500 would include seven radiating elements 120 in each array 510 as opposed to fourteen radiating elements 120 as in the other embodiments described above. While ellipsoidal RF lenses 530 are shown in FIG. 12, it will be appreciated that spherical RF lenses may be used in other embodiments.

Base station antennas may generate grating lobes, which refer to sidelobes that are formed at high elevation angles. Grating lobes, if present, may severely degrade the performance of a base station antenna, as the grating lobes represent lost power and may increase interference with neighboring sectors or base stations. Grating lobes tend to increase in magnitude when the spacing between adjacent radiating elements in a linear array is made too large. Accordingly, in traditional linear arrays, adjacent radiating elements are typically spaced apart by less than one wavelength in order to suppress grating lobes.

The base station antennas according to embodiments of the present invention include a stagger in the horizontal direction. As a result, the distance D3 between a radiating element 120 in the first column (i.e., a radiating element aligned along vertical axis V1) and an "adjacent" radiating element 120 in the second column (i.e., a radiating element aligned along vertical axis V2) includes both a horizontal component and a vertical component. In order to suppress grating lobes, the base station antennas according to some embodiments of the present invention may reduce the vertical spacing between adjacent radiating elements that are in different columns. For example, as best shown in FIG. 13, the radiating elements 120 that are mounted on the same feed board 112 may be vertically spaced apart from each other by a first distance D1. Two adjacent radiating elements 120 that are in different columns may be vertically spaced apart from each other by a second distance D2 that may be less than the distance D1. In some embodiments, the distance D3 shown in FIG. 13 may be approximately equal to the distance D1.

Pursuant to further embodiments of the present invention, RF lens end caps are provided that may be used to mount RF lens within a base station antenna. As discussed above, RF lenses having a cylindrical shape are used in a number of base station antenna designs. In many cases, the RF lens may extend the full length of the base station antenna, and hence may be large and relatively heavy. As such, a fairly extensive support structure has conventionally been used to mount cylindrical RF lenses within a base station antenna.

Figure 14A:
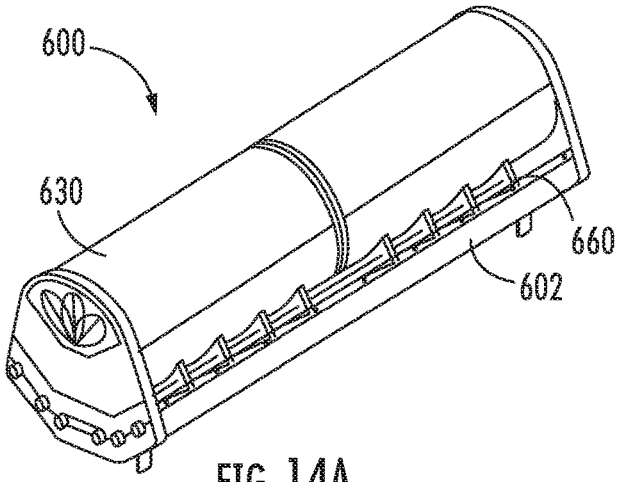
FIGS. 14A-14D are perspective and end views illustrating a conventional approach for supporting a cylindrical RF lens within a base station antenna.
Figure 14B:
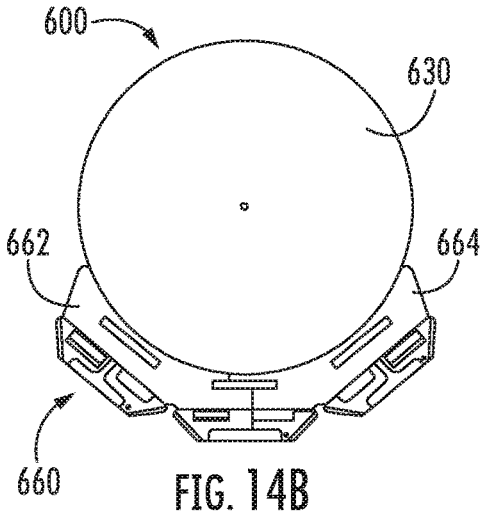
Figure 14C:
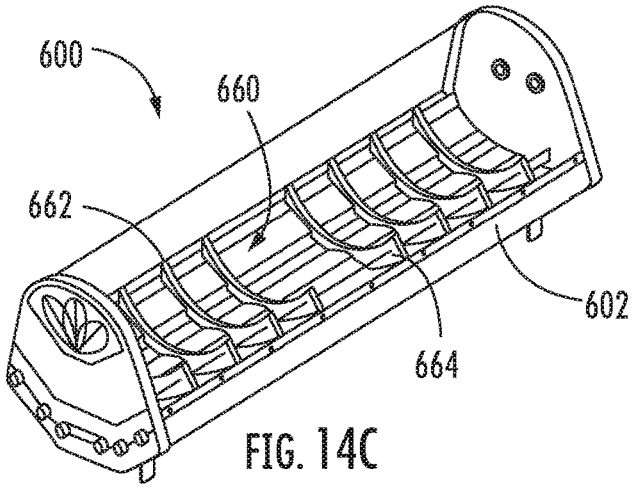
Figure 14D:
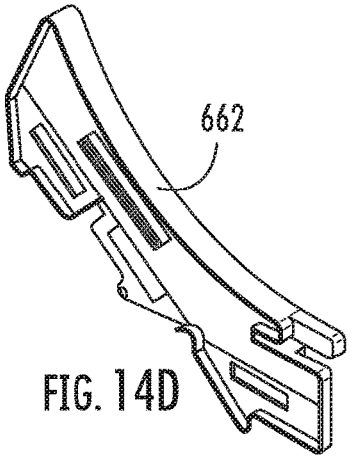

FIGS. 14A-14D illustrate a conventional approach for supporting a cylindrical RF lens within the housing of a base station antenna. As shown in FIGS. 14A-14B, the conventional base station antenna 600 includes a cylindrical RF lens 630 that extends the entire length of the antenna 600. A plurality of lens supports 660 are provided that physically support and position the RF lens 630 within the base station antenna 600. The supports 660 are spaced apart from each other in the vertical direction (i.e., along the longitudinal axis of the base station antenna 600), and a large number of supports 660 may be required (eight supports 660 are used in base station antenna 600). As can best be seen with reference to FIGS. 14B and 14D, each lens support 660 includes first and second support pieces 662, 664, and thus a total of sixteen support pieces 662, 664 are included in base station antenna 600 to support the RF lens 630. As shown in FIGS. 14A and 14C, the lens supports 660 are mounted to extend forwardly from the frame of the base station antenna 600. In particular, the lens supports 660 are mounted to, and extend forwardly from, the reflector 602. The lens supports 660 space the RF lens 630 apart from the radiating elements of base station antenna 600, and maintain the RF lens 630 at the proper distance from the radiating elements.

In many cases, RF lenses may be formed by filling a dielectric lens casing with one or more RF energy focusing materials that are designed to focus RF energy. The lens casing may comprise, for example, a plastic or other dielectric container, and the RF energy focusing materials may comprise, for example, small blocks of RF energy focusing material (which may facilitate randomly orienting conductive materials that may be included in the small blocks) or a dielectric material that is in semi-solid (or even liquid) form. Pursuant to further embodiments of the present invention, lensed base station antennas are provided that have RF lenses that include lens casings having integrated mounting features that may eliminate the need for separate supports such as the lens supports 660 discussed above.

In particular, pursuant to embodiments of the present invention, lensed base station antennas are provided that have lens casings that include a pair of lens end caps and a body. The body of the lens casing may comprise a thin cylindrical structure that is open on both ends, and the lens end caps may cover the respective open ends of the body. The body of the lens casing may be formed of, for example, fiberglass or another rigid material. Each lens end cap may include integrated mounting features that are configured to be mounted on the reflector of the base station antenna or on another portion of the frame of the antenna. Since the body of the lens casing is rigid, it may be possible to stably mount the body in position within the antenna using only a pair of mounting features, as opposed to the large number of mounting features used in at least some conventional lensed base station antennas. Moreover, the mounting features may, in some embodiments, be integrated directly into the lens end caps, so that no additional RF lens mounting parts may be required in the base station antenna.

Figure 15A:
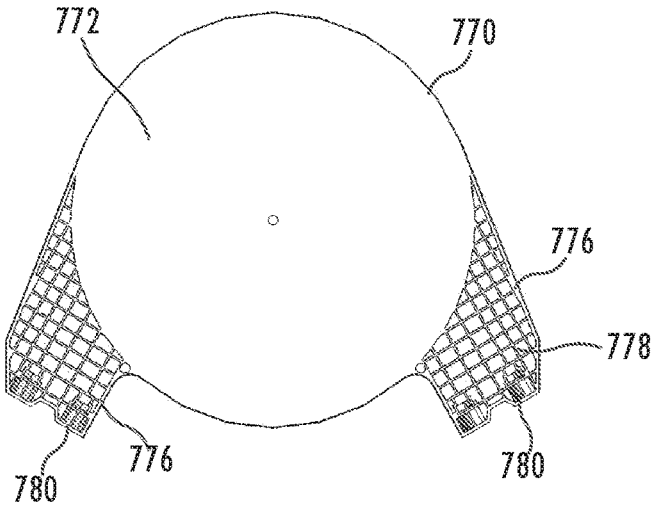
FIGS. 15A-15B are inner and outer views of an RF lens end cap according to embodiments of the present invention.
Figure 15B:
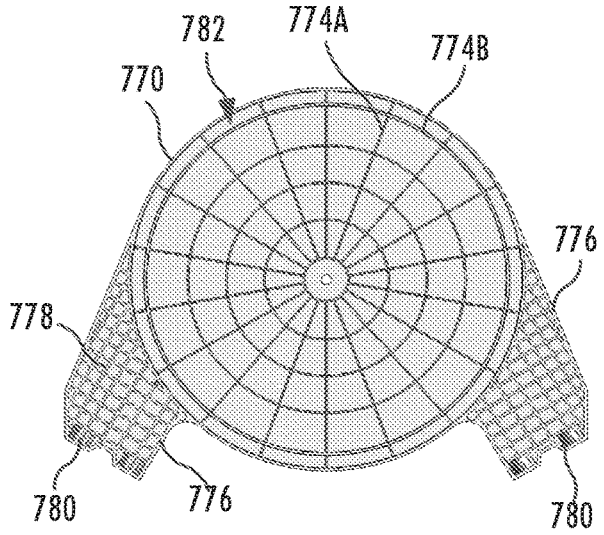
Figure 15C:
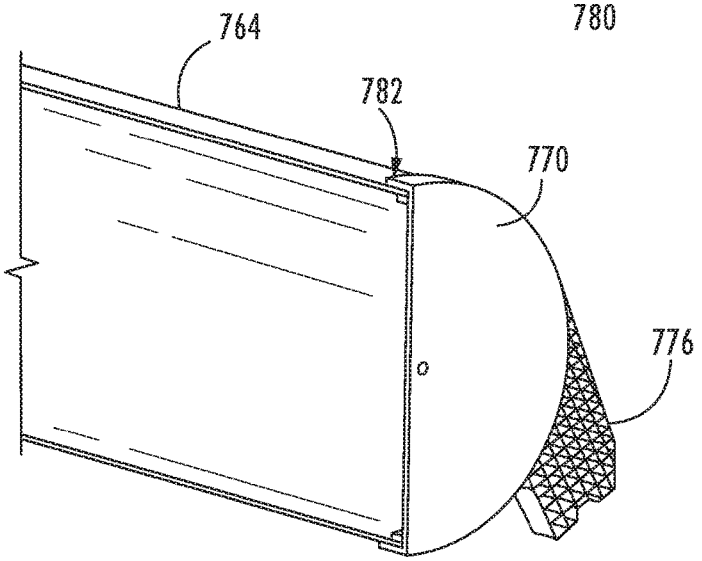
FIG. 15C is a cross-sectional view of a portion of an RF lens casing that includes the lens end caps of FIGS. 15A-15B.

FIGS. 15A-15B are inner and outer views, respectively, of an RF lens end cap 770 according to embodiments of the present invention. FIG. 15C is a cross-sectional view of a portion of an RF lens casing 762 that includes lens end cap of FIGS. 15A-15B.

Referring to FIGS. 15A-15C, it can be seen that the lens end cap 770 comprises a disk-like structure having a circular central region 772. As shown in FIG. 15B, the interior side of the lens end cap (i.e., the top side of the bottom end cap, and the bottom side of the top end cap) may have a plurality of support ribs 774A, 774B that may increase the strength and rigidity of the lens end cap 770. In the depicted embodiment, both radial support ribs 774A as well as circular support ribs 774B are provided. While support ribs 774A, 774B are provided on the inner surface of the lens end cap 770 in the depicted embodiment, it will be appreciated that in other embodiments the support ribs 774A, 774B may be alternatively provided on the outer surface of the lens end cap 770, provided on both the inner and outer surfaces of the lens end cap 770, or be omitted.

The lens end cap 770 further includes a pair of rearwardly extending flanges 776 that extend from generally opposed side surfaces of the circular central region 772. The flanges 776 may also each include support ribs 778. In the depicted embodiment, each flange 776 includes support ribs 778 on both sides thereof to provide enhanced strength and rigidity, but other configuration are possible depending upon specific needs. Each flange 776 may further include mounting points 780 such as bosses that comprise strengthened regions in the flange 776 that have a central opening (not visible in the drawings). The mounting points 780 may, for example, be designed to receive the shaft of a bolt so that the lens end cap 770 may be bolted to another structure of a base station antenna, such as a reflector.

Referring to FIG. 15C, it can be seen that the outer two of the circular support ribs 774B are taller than the other support ribs 774B, and form a circular channel 782 that receives the body 764 of the lens casing 762.

Figure 16A:
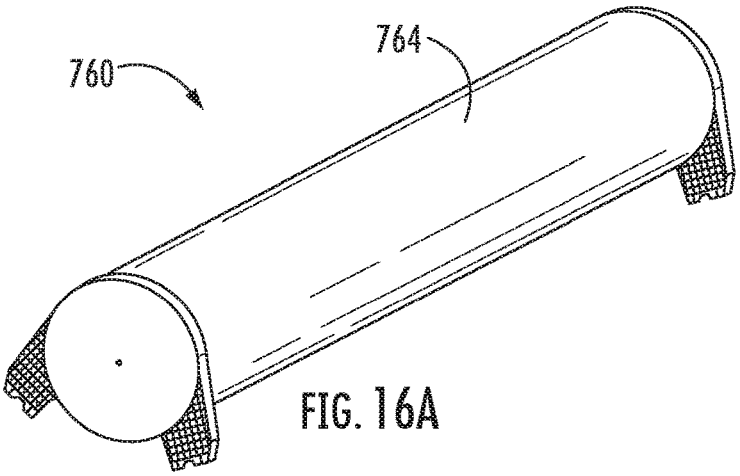
FIGS. 16A-16C are various views illustrating how an RF lens including two of the lens end caps of FIGS. 15A-15C may be mounted within a base station antenna.
Figure 16B:
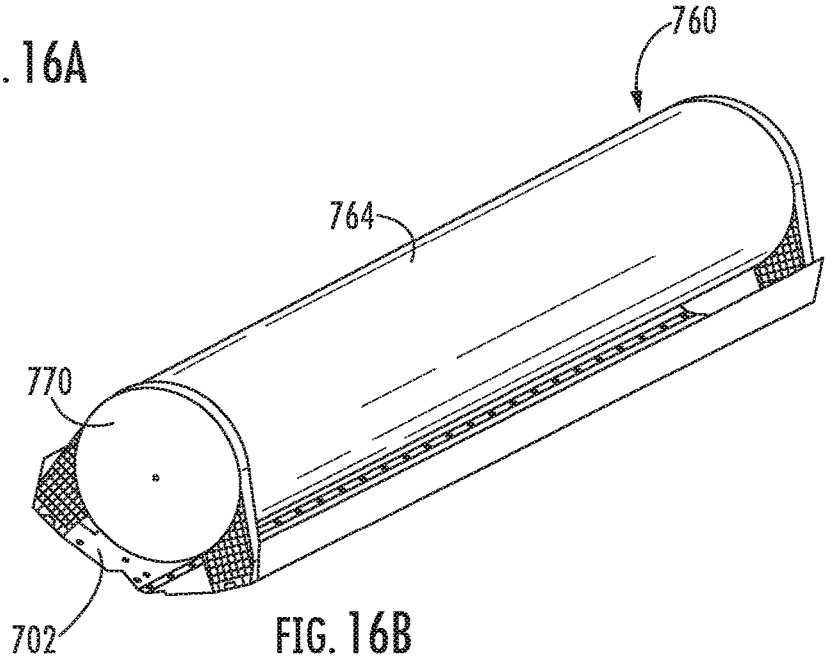
Figure 16C:
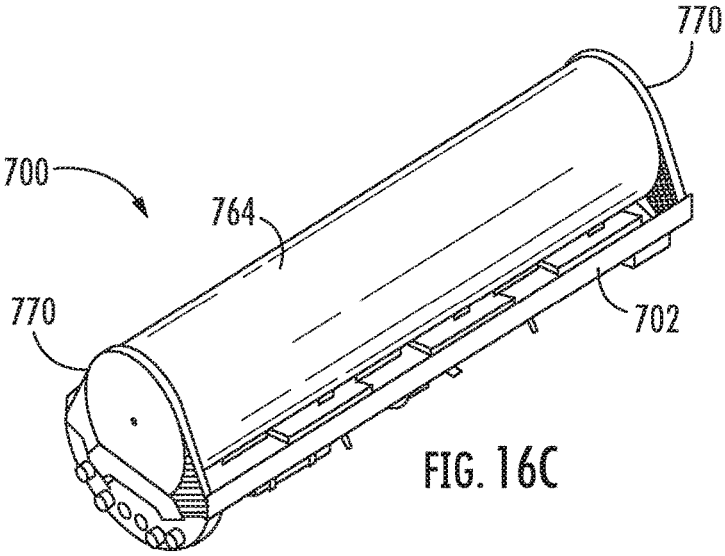

FIGS. 16A-16C are various views illustrating how two of the lens end caps 770 of FIGS. 15A-15C may be used to mount an RF lens 760 having lens end caps 770 according to embodiments of the present invention within a base station antenna 700. FIG. 16A is a perspective view of the RF lens 760. As shown in FIG. 16A, the RF lens 760 includes a lens casing 762 that includes a body 764 and a pair of lens end caps 770. The body 764 may be formed, for example, as an open-ended fiberglass cylinder that is formed by pultrusion. While fiberglass may be a particularly good material for the body 764 of the lens casing 762 due to its strength, rigidity, material cost, ease of manufacture and RF properties, it will be appreciated that other materials may be used to form the body 764 of the lens casing 762, such as a variety of different plastics. The lens end caps 770, which are described in detail above with reference to FIGS. 15A-15C, may be formed of a polymeric material such as, for example, ABS or the like. The end caps 770 may be formed by, for example, injection molding. The lens casing 762 may be filled with an RF energy focusing material. For example, any of the RF energy focusing materials disclosed in U.S. patent application Ser. No. 15/882,505, filed Jan. 29, 2018, the entire content of which is incorporated herein by reference, may be used as the RF energy focusing materials that are deposited in the lens casing 762 to form the RF lens 760.

As shown in FIG. 16B, the lens casing 762 may be mounted on, for example, a reflector 702 of the base station antenna 700 or some other portion of the frame of the antenna. In particular, holes may be formed in the reflector 702 adjacent each of the mounting points 780 on the flanges 776 of each lens end cap 770. Bolts (not visible in the figures) may be passed through the holes in the reflector 702 and through the openings in the respective mounting points 780 and nuts may be threaded onto the bolts to attach the lens end caps 770 to the reflector 702, and hence to firmly fix either end of the RF lens 760 to the reflector 702. The stiffness of the body 764 may ensure that the central portion of the RF lens 760 is maintained in its proper position within the base station antenna 700.

It will be appreciated that the present specification only describes a few example embodiments of the present invention and that the techniques described herein have applicability beyond the example embodiments described above. For example, while the example embodiments above focus on base station antennas that transmit and receive signals in the 1.7-2.7 GHz frequency range, it will be appreciated that staggered vertical arrays may be used in other operating frequency bands. In fact, the present invention may be particularly applicable for use in higher frequency bands such as, for example, frequency bands in the 3-6 GHz range, since the size of the radiating elements and RF lenses are reduced at higher frequencies and hence lensed base station antennas may be particularly well-suited for use in such frequency bands.

As another example, while the example embodiments described above are suitable for using three base station antennas to implement a six-sector base station, it will be appreciated that additional staggered vertical arrays may be included to, for example, use three base station antennas to implement nine-sector or twelve-sector base stations. Thus, for example, while various of the appended claims refer to lensed base station antennas that include first and second staggered vertical arrays, it will be appreciated that this means these antennas include at least two staggered vertical arrays, since three or even more staggered vertical arrays will be appropriate for various applications. It will also be appreciated that while the above embodiments use −45°/+45° cross-dipole radiating elements, any appropriate radiating elements may be used. Additionally, each staggered vertical array may have a single associated RF lens or a plurality of associated RF lenses (e.g., an RF lens for each radiating element of the array, an RF lens for each pair of radiating elements in the array, etc.).

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A lensed base station antenna, comprising:

a first array that includes a plurality of first radiating elements that are configured to transmit respective sub-components of a first radio frequency ("RF") signal;

a second array that includes a plurality of second radiating elements that are configured to transmit respective sub-components of a second RF signal; and an RF lens structure positioned to receive electromagnetic radiation from a first of the first radiating elements and from a first of the second radiating elements, wherein a first subset of the first radiating elements are aligned along a first vertical axis and a second subset of the first radiating elements are aligned along a second vertical axis that is spaced apart from the first vertical axis, and wherein the first array includes a single radiating element per horizontal row in the first array, and the second array includes a single radiating element per horizontal row in the second array.

2. The lensed base station antenna according to claim 1, wherein a first subset of the second radiating elements are aligned along a third vertical axis and a second subset of the second radiating elements are aligned along a fourth vertical axis that is spaced apart from the third vertical axis.

3. The lensed base station antenna according to claim 2, wherein the first radiating elements are mounted to extend forwardly from a first section of a reflector and the second radiating elements are mounted to extend forwardly from a second section of the reflector, and wherein a front surface of a first plane defined by the first section of the reflector and a front surface of a second plane defined by the second section of the reflector intersect at an oblique angle.

4. The lensed base station antenna according to claim 1, wherein a horizontal distance between the first vertical axis and the second vertical axis is between 0.1 and 0.5 wavelengths of a center frequency of an operating frequency band of the first radiating elements.

5. The lensed base station antenna according to claim 1, wherein a boresight pointing direction for the first of the first radiating elements does not intersect a longitudinal axis that extends through a center of the RF lens structure.

6. The lensed base station antenna according to claim 1, wherein the RF lens structure comprises a cylindrical RF lens structure having a vertically-extending longitudinal axis.

7. The lensed base station antenna according to claim 2, further comprising a third array that includes a plurality of third radiating elements that are configured to transmit respective sub-components of a third RF signal, wherein a first subset of the third radiating elements are aligned along a fifth vertical axis and a second subset of the third radiating elements are aligned along a sixth vertical axis that is spaced apart from the fifth vertical axis, and wherein the RF lens structure is positioned to receive electromagnetic radiation from a first of the third radiating elements.

8. The lensed base station antenna according to claim 1, wherein a minimum vertical spacing between two vertically-adjacent radiating elements that are aligned along the first vertical axis is greater than a minimum vertical spacing between a radiating element that is aligned along the first vertical axis and a vertically-adjacent radiating element that is aligned along the second vertical axis.

9. The lensed base station antenna according to claim 1, further comprising a frame that includes a reflector, wherein the RF lens structure includes a lens casing having a body and a first lens end cap mounted on a first end of the body, and wherein the first lens end cap includes a first flange that is configured to mount the RF lens structure to the frame.

10. A lensed base station antenna, comprising:

a first radio frequency ("RF") port;

a first array that includes a plurality of radiating elements that are connected via a feed network to the first RF port, wherein a first vertical axis that passes through a center of a first of the radiating elements in the first array is spaced apart from a second vertical axis that passes through a center of a second of the radiating elements in the first array;

a second RF port;

a second array that includes a plurality of radiating elements that are connected via a feed network to the second RF port, wherein a third vertical axis that passes through a center of a first of the radiating elements in the second array is spaced apart from a fourth vertical axis that passes through a center of a second of the radiating elements in the second array; and an RF lens structure positioned to receive electromagnetic radiation from at least one of the radiating elements in the first array and from at least one of the radiating elements in the second array.

11. The lensed base station antenna according to claim 10, wherein the radiating elements of the first array are arranged in at least two columns and a plurality of rows, and at least some of the rows of radiating elements in the first array include a single radiating element, and wherein the radiating elements of the second array are arranged in at least two columns and a plurality of rows, at least some of the rows of radiating elements in the second array include a single radiating element.

12. The lensed base station antenna according to claim 11, wherein all of the rows of radiating elements in the first array include a single radiating element, and all of the rows of radiating elements in the second array include a single radiating element.

13. The lensed base station antenna according to claim 10, further comprising a plurality of first feed boards, each first feed board having two or more of the radiating elements in the first array mounted thereon, wherein a first subset of the first feed boards are aligned along the first vertical axis and a second subset of the first feed boards are aligned along the second vertical axis.

14. The lensed base station antenna according to claim 10, wherein the first array is configured to cover a first sub-sector of a 120° sector and the second array is configured to cover a second different sub-sector of the 120° sector, and wherein a peak amplitude of an antenna beam generated by the first array is at an azimuth angle that is offset from an azimuth angle that is at a center of the first sub-sector.

15. The lensed base station antenna according to claim 10, wherein a subset of the radiating elements in the first array are aligned along a third vertical axis that is between the first vertical axis and the second vertical axis.

16. The lensed base station antenna according to claim 10, wherein at least some of the radiating elements in the first array are mounted to extend forwardly from a first section of a reflector and at least some of the radiating elements in the second array are mounted to extend forwardly from a second section of the reflector, and wherein a front surface of a first plane defined by the first section of the reflector and a front surface of a second plane defined by the second section of the reflector intersect at an oblique angle that is between 100° and 140°.

17. A lensed base station antenna that is configured to transmit signals in both a low frequency band and a high frequency band, comprising:

a first radio frequency ("RF") port;

a first array that includes a plurality of radiating elements that are connected via a feed network to the first RF port, each radiating element in the first array vertically spaced apart from all other radiating elements in the first array; and an RF lens structure positioned to receive electromagnetic radiation from at least one of the radiating elements in the first array, wherein at least some of the radiating elements in the first array are staggered in a horizontal direction from others of the radiating elements in the first array and positioned at a distance from the RF lens structure so that a first antenna beam generated by the first array in response to an RF signal in the high frequency band is narrower in an azimuth plane than a second antenna beam generated by the first array in response to an RF signal in the low frequency band.

18. The lensed base station antenna according to claim 17, further comprising:

a second array that includes a plurality of radiating elements that are connected via a second feed network to a second RF port, each radiating element in the second array vertically spaced apart from all other radiating elements in the second array, wherein the RF lens structure is further positioned to receive electromagnetic radiation from at least one of the radiating elements in the second array, and wherein at least some of the radiating elements in the second array are staggered in a horizontal direction from others of the radiating elements in the second array.

19. The lensed base station antenna according to claim 18, wherein the radiating elements in the first array are mounted to extend forwardly from a first section of a reflector and the radiating elements in the second array are mounted to extend forwardly from a second section of the reflector, and wherein a front surface of a first plane defined by the first section of the reflector and a front surface of a second plane defined by the second section of the reflector intersect at an oblique angle that is between 100° and 140°.

20. The lensed base station antenna according to claim 17, wherein the first array is configured to cover a first sub-sector of a 120° sector and the second array is configured to cover a second different sub-sector of the 120° sector, and wherein a peak amplitude of an antenna beam generated by the first array is at an azimuth angle that is offset from an azimuth angle that is at a center of the first sub-sector.

* * * * *